United States Patent [19]

Ishikawa et al.

[11] Patent Number: 4,980,721

[45] Date of Patent: Dec. 25, 1990

[54] COPYING APPARATUS HAVING A CONTROLLER CAPABLE OF SORTING GROUPS OF ORIGINALS IN DIFFERENT BINS BY DETECTING A BOUNDARY BETWEEN THE GROUPS

[75] Inventors: Takuma Ishikawa; Akiyoshi Johdai, both of Osaka, Japan

[73] Assignee: Minolta Camera Kabushiki Kaisha, Osaka, Japan

[21] Appl. No.: 293,366

[22] Filed: Jan. 4, 1989

[30] Foreign Application Priority Data

Jan. 6, 1988 [JP] Japan ..... 63-1749
Jan. 6, 1988 [JP] Japan ..... 63-1750
Jan. 6, 1988 [JP] Japan ..... 63-1751

[51] Int. Cl.[5] ..... G03G 15/00

[52] U.S. Cl. ..... 355/323; 355/313; 355/311

[58] Field of Search ..... 355/208, 308, 311, 321, 355/323, 313

[56] References Cited

U.S. PATENT DOCUMENTS

| | | | |
|---|---|---|---|
| 3,830,590 | 8/1974 | Harris et al. | 355/323 |
| 4,358,197 | 11/1982 | Kukucka et al. | 355/323 X |
| 4,442,505 | 4/1984 | Takano . | |
| 4,449,813 | 5/1984 | Kikuchi et al. | 355/323 X |
| 4,522,486 | 6/1985 | Clark et al. | 355/323 |
| 4,530,593 | 7/1985 | Kasuya et al. | 355/323 |
| 4,572,653 | 2/1986 | Ito et al. | 355/208 X |
| 4,575,227 | 3/1986 | Ito et al. . | |
| 4,609,283 | 9/1986 | Murata et al. . | |
| 4,681,425 | 7/1987 | Tanimoto | 355/309 |
| 4,688,924 | 8/1987 | Anzai et al. | 355/323 |
| 4,816,864 | 3/1989 | Tanaka et al. . | |

FOREIGN PATENT DOCUMENTS 56-83754 7/1981 Japan .
57-181559 11/1982 Japan .

*Primary Examiner*—R. L. Moses
*Attorney, Agent, or Firm*—Burns, Doane, Swecker & Mathis

[57] ABSTRACT

A copying apparatus having an automatic document feeder (ADF), and a sorter having a plurality of bins. The apparatus comprises an input mechanism for setting the number of sheets to be copied with respect to one original document; a detecting system for detecting a boundary between units of originals; a first control system for controlling the sorter so that the bins are altered one to another every time the boundary is detected by the detecting system when the number of sheets is set to one; a second control system for controlling the sorter so that the bins are altered one to another when the number of copied sheets accommodated in one bin exceeds its capacity of each bin while a copying operation for one unit of originals is being performed. When a sheet, inserted between units of originals, whose size is different from the sizes of original documents is fed by the ADF, the detecting system judges that it is the boundary therebetween. The sorter is controlled so as to automatically accommodate copied sheets of one unit of originals in one bin. Further, every time the boundary is detected, bins are shifted by one step, respectively so that copied sheets are accommodated in one bin for each of units of originals. Thus, units of the copied sheets corresponding to units of originals are separately accommodated in the respective bins.

15 Claims, 24 Drawing Sheets

COPYING APPARATUS HAVING A CONTROLLER CAPABLE OF SORTING GROUPS OF ORIGINALS IN DIFFERENT BINS BY DETECTING A BOUNDARY BETWEEN THE GROUPS

BACKGROUND OF THE INVENTION

1. Field of the invention

The present invention relates to a copying apparatus, and more particularly, to a copying apparatus provided with an automatic document feeder and a sorter.

2. Description of the related art

In recent years, there has been a growing demand for automatic paper handling devices in carrying out a copying operation. In order to meet the demand, various types of auxiliary devices of a copying apparatus have been developed and put to practical use. For example, one of such auxiliary devices is an automatic document feeder which automatically feeds original documents one by one to the copying apparatus, and another is a sorter which sorts and groups copy paper sheets (hereinafter referred to as copy sheet).

According to a known automatic document feeder, a unit of originals comprising one original document or more placed on an original document-placing tray is sequentially fed to an exposure position until the last one of original documents has been fed thereto, and then, discharged from the copying apparatus. When a plurality of units of originals is set on the automatic document feeder with one unit of originals piled on the other, all of the copy sheets are discharged to the same tray. It is troublesome to separate the copy sheets removed from the tray from each other for every unit of originals. In order to avoid such a troublesome sheet-separating work in carrying out the copying operations of a plurality of units of originals by such an automatic document feeder, an operator is kept waiting for a few minutes with some bins being empty as long as the copying of the preceding unit of originals is in operation with the ADF unit before the operator performs the copying of the following units of originals. Further, every time the copying of a different unit of originals is performed, the operator has to perform various operations, which causes the loss of time and labor.

SUMMARY OF THE INVENTION

Accordingly, an essential object of the present invention is to provide an improved copying apparatus which can overcome such disadvantages as described above.

In accomplishing this and other objects, one aspect of the present invention is an improved copying apparatus which comprises an automatic original document feeding means, provided with an original document-placing tray, for feeding original documents placed on the original document-placing tray to a predetermined position sheet by sheet; a copying means for copying an image of the original document placed on the predetermined position onto a copy paper sheet; a sorting means having a plurality of bins to accommodate copy sheets completed for copying and a distribution mechanism for distributing the copy sheets to the bins; an input means for setting the number of copy sheets to be copied; a discrimination means for discriminating a boundary between units of originals placed on the original document-placing tray, each of the units of originals including one or more original documents; a first control means for controlling the sorting means so as to change one of the bins to another to accommodate the copy sheets to be distributed every time the boundary is detected by the discrimination means on condition that the number of copy sheets to be copied is set to one; and a second control means for controlling the sorting means so as to change one of the bins to another to accommodate the copy sheets when the number of the copy sheets accommodated in the one bin exceeds a predetermined number of sheets to be accommodated therein while a copying operation for the each unit of originals are being performed.

In the above-described copying apparatus, original documents placed on the original document-placing tray are fed to a predetermined position by the automatic original document feeding means. Each boundary among the units of originals is discriminated by the discrimination means. Various methods for discriminating the boundary between the units of originals may be adopted. The discrimination means may include a detecting means for detecting sizes of original documents. A boundary interposed therebetween is detected by the detecting means according to the difference in the sizes of the original documents to be fed. More specifically, a partitioning sheet is inserted therebetween, whose size is different from the sizes of the units of originals. And the boundary interposed therebetween is decided by detecting the partitioning sheet by the detecting means. In the case in which a predetermined number of sheets to be copied is set to "1", every time the boundary between different units of originals is detected, bins which accommodate copy sheets are automatically altered according to the units of originals. In other words, copy sheets are distributed to the bins and accommodated therein according to every unit of originals. If the number of copy sheets of one unit of originals exceeds a predetermined number of sheets which a bin may accommodate, bins are automatically altered since it is so designed that copy sheets subsequently discharged from the copying apparatus are accommodated in different bins.

According to the present invention, copy sheets are distributed to at least one bin and accommodated therein for each of the units of originals, which eliminates the need for separating copy sheets from each other for every unit of originals. Further, since a plurality of units of originals can be successively copied, the time to be spent in making a copying operation can be reduced.

BRIEF DESCRIPTION OF THE DRAWINGS

These and other objects and features of the present invention will become apparent from the following description taken in conjunction with the preferred embodiment thereof with reference to the accompanying drawings, in which.

Figure 6:
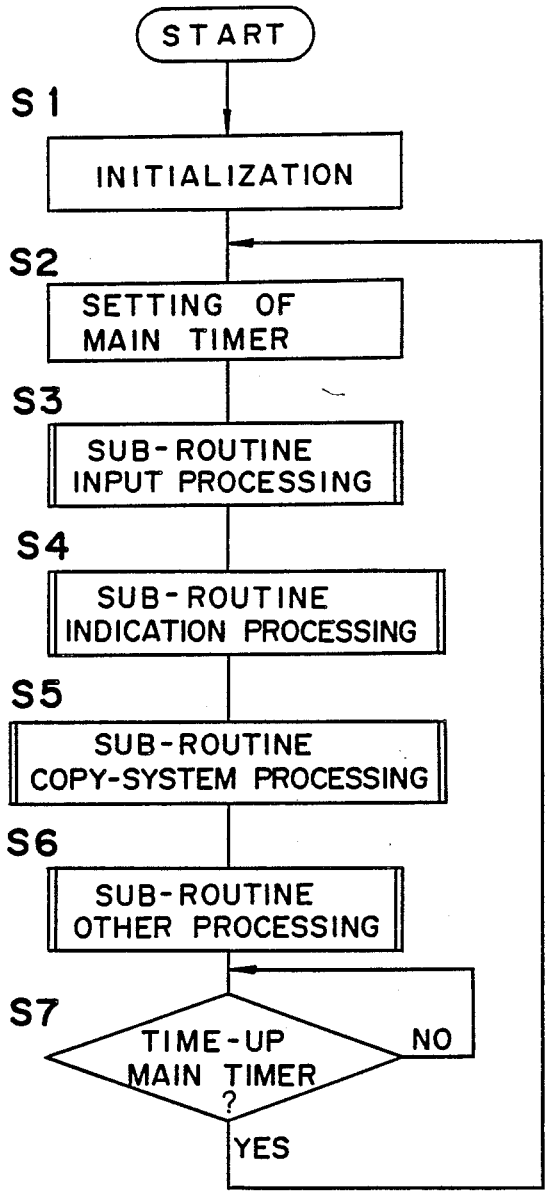
FIG. 6 is a flow-chart showing a main routine of a control procedure of the copying apparatus.
Figure 8:
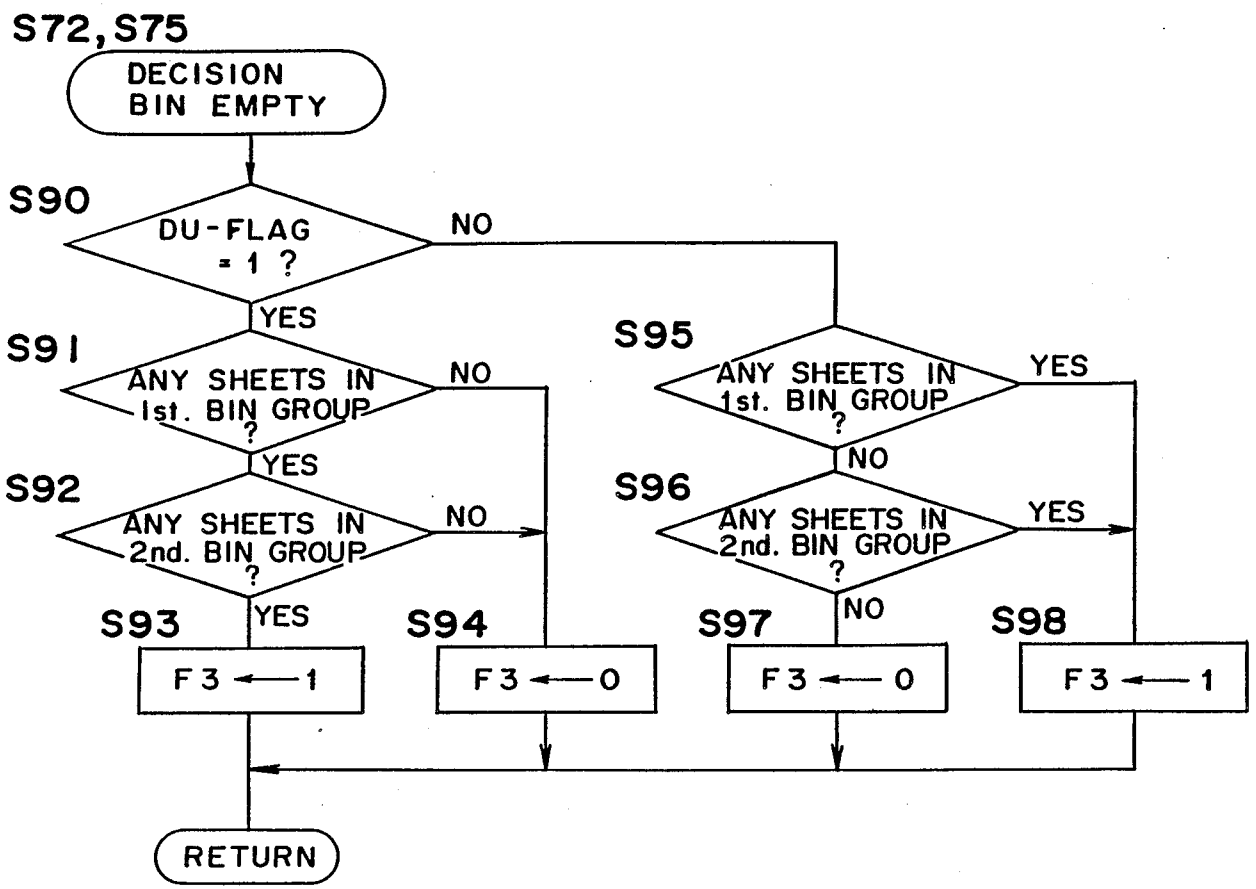

FIGS. *7a, 7b, 7c, 7d, 7e* and *7f* are, respectively, one of flow-charts showing one subroutine, which is divided into six sections, in the main routine shown in FIG. 6;

FIG. 8 is a flow-chart showing one of the subroutines in FIG. *7e;*

Figure 9:
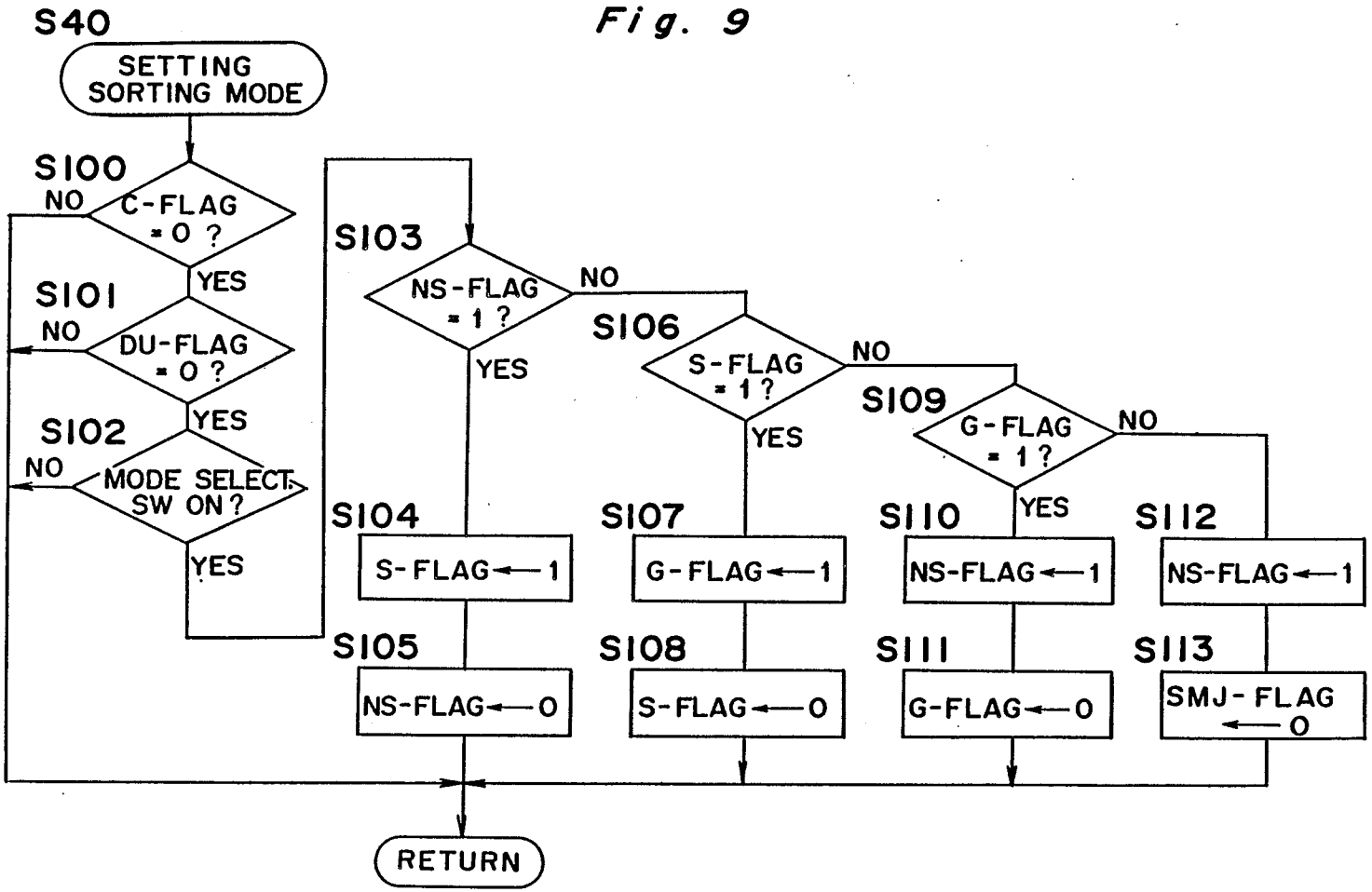

FIG. 9 is a flow-chart showing one of the subroutines in FIG. *7b;*

Figure 10:
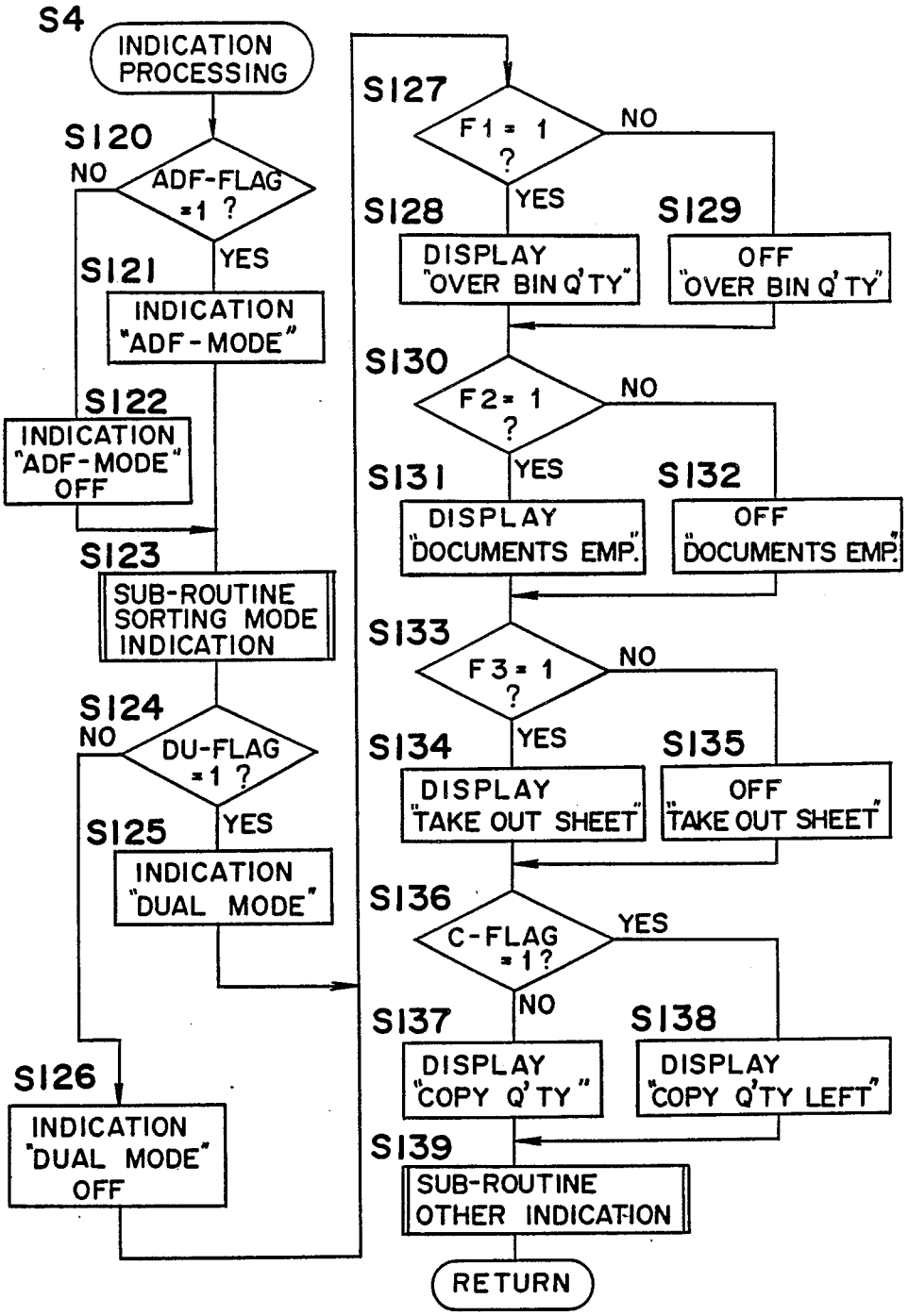
Figure 11:
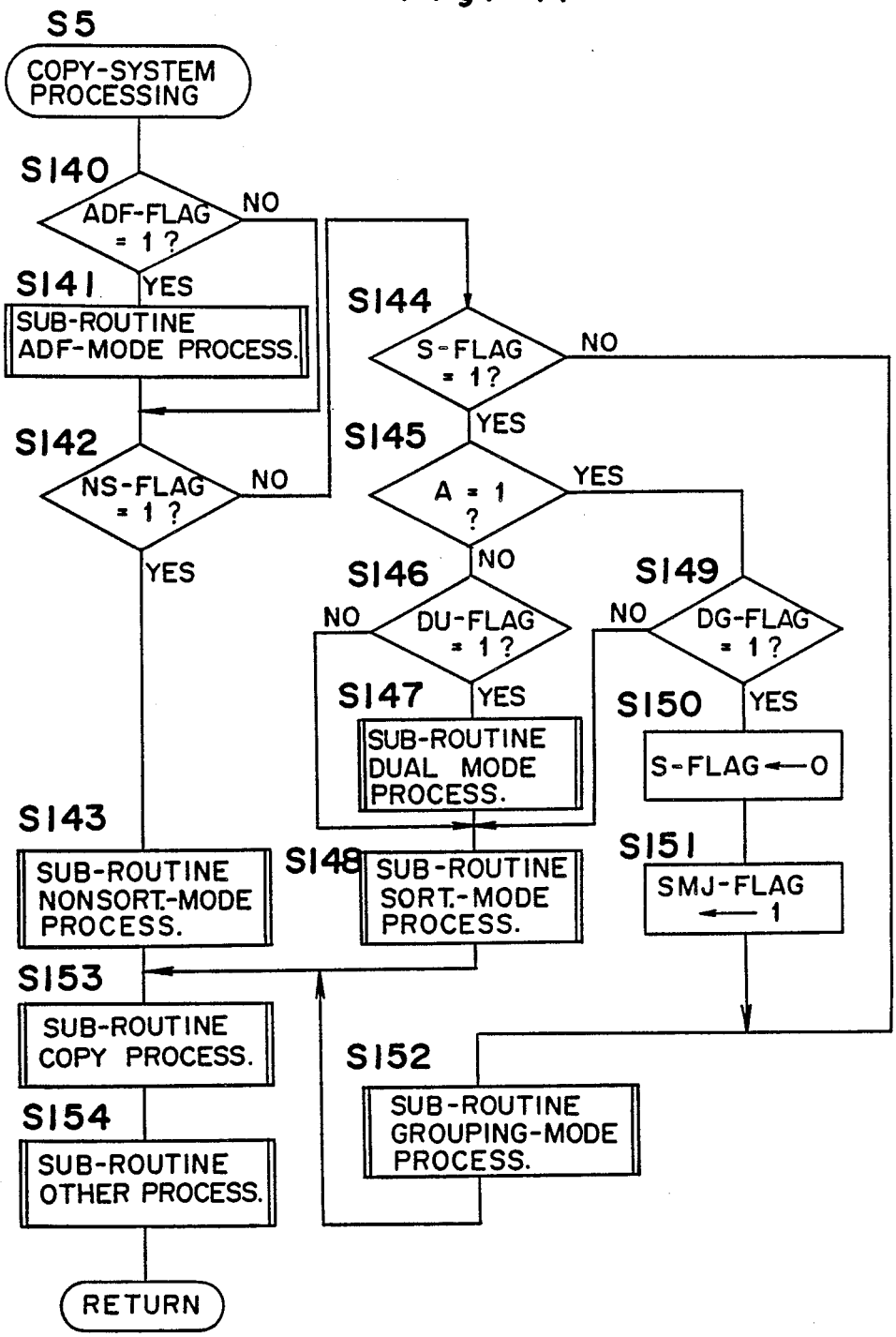
Figure 12:
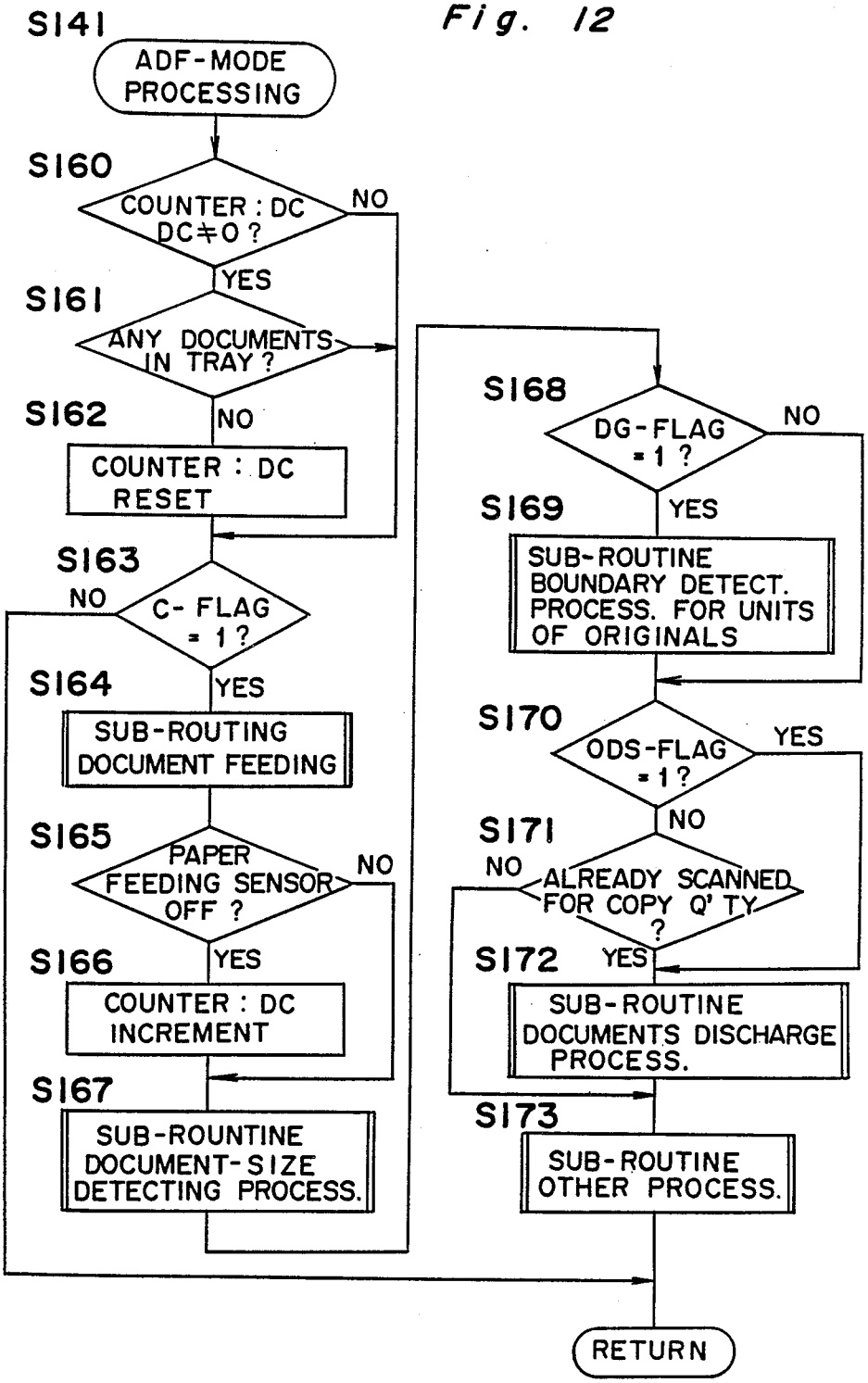
Figure 13:
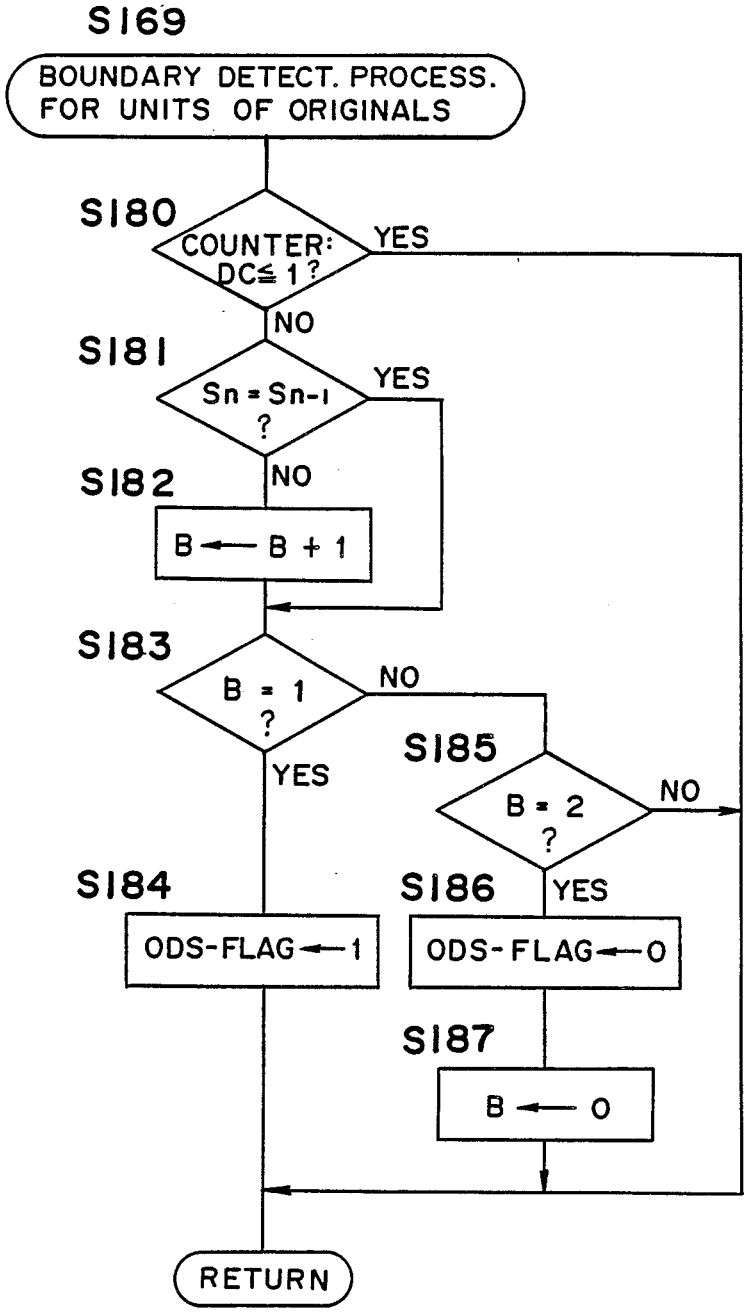
Figure 14:
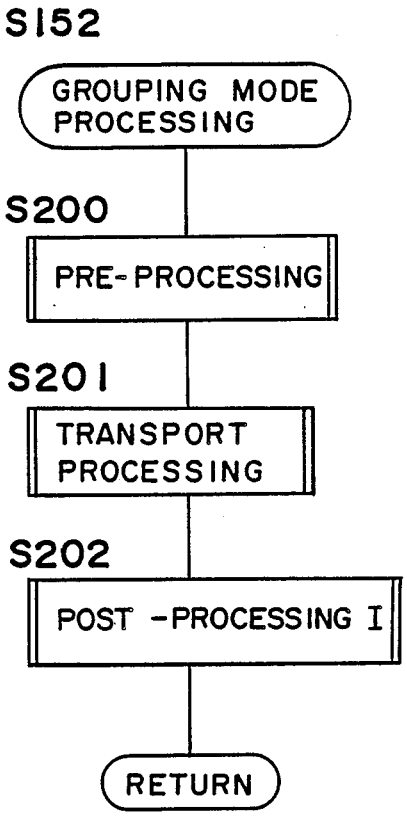
Figure 19:
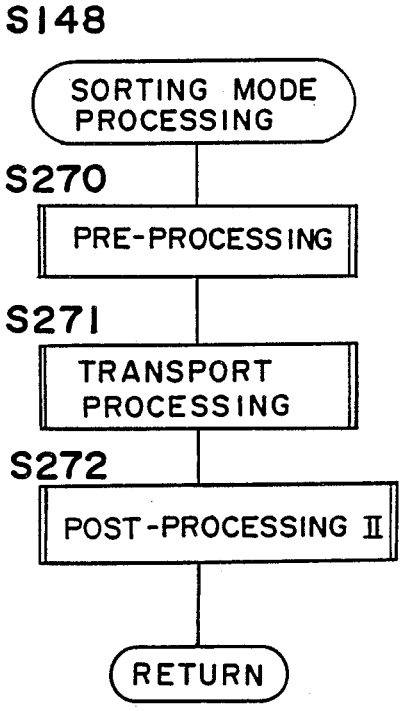
Figure 15:
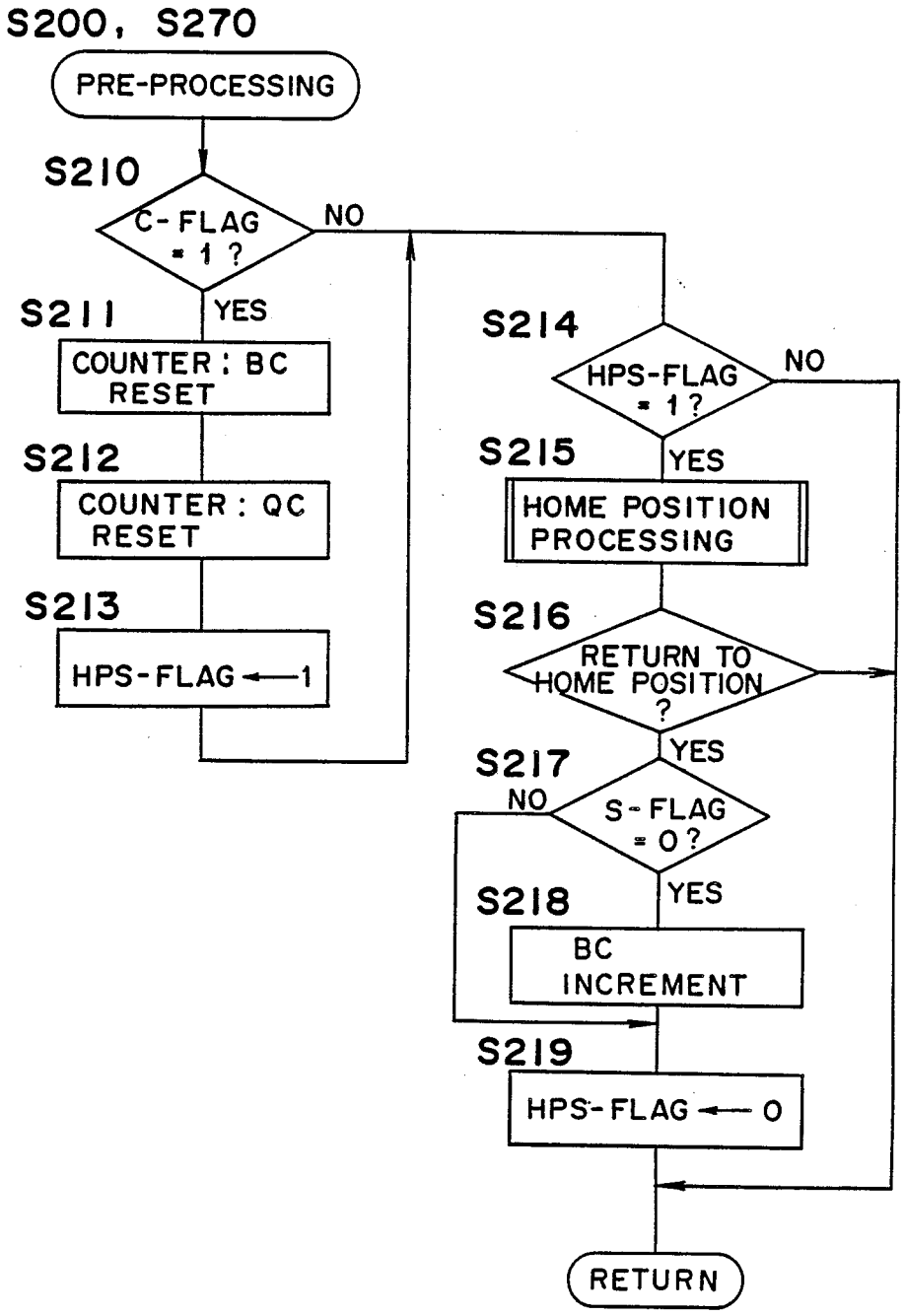
Figure 16:
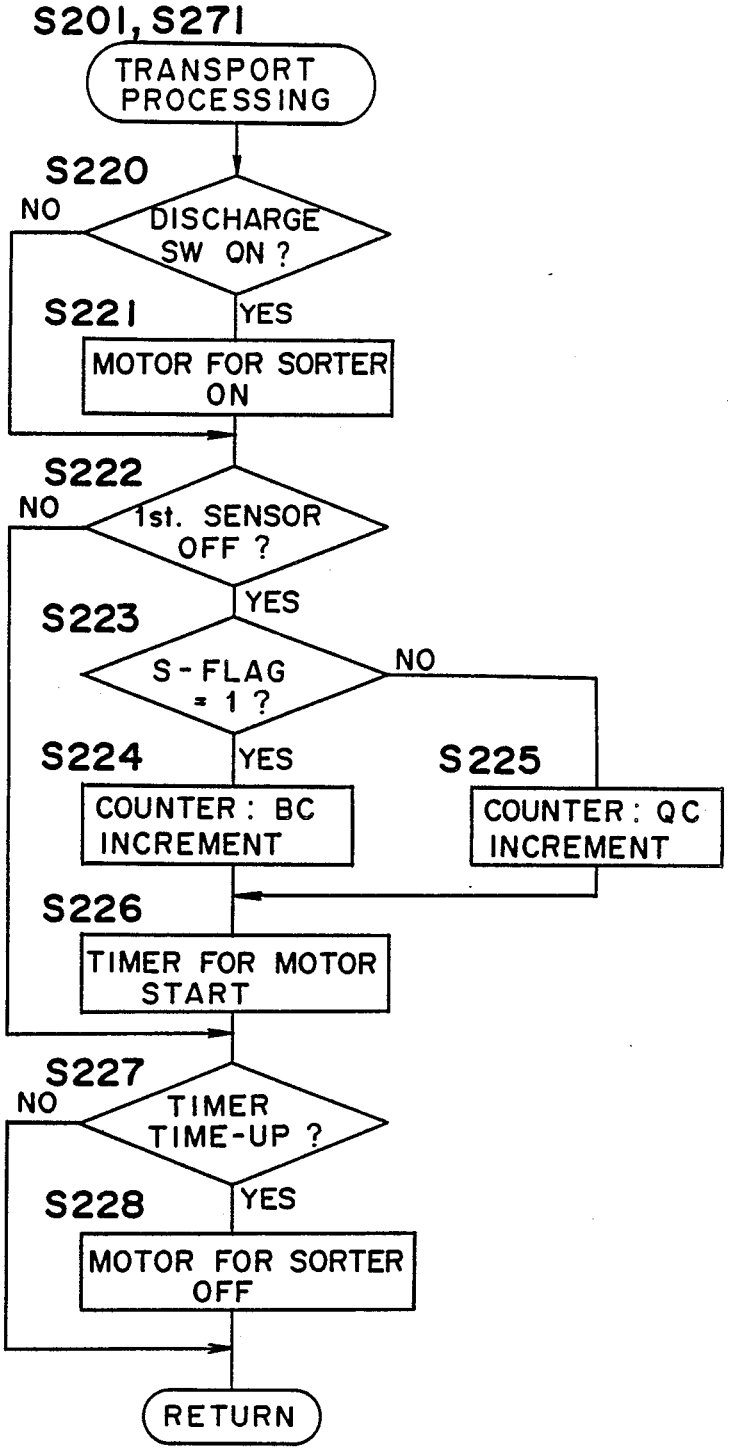
Figure 17A:
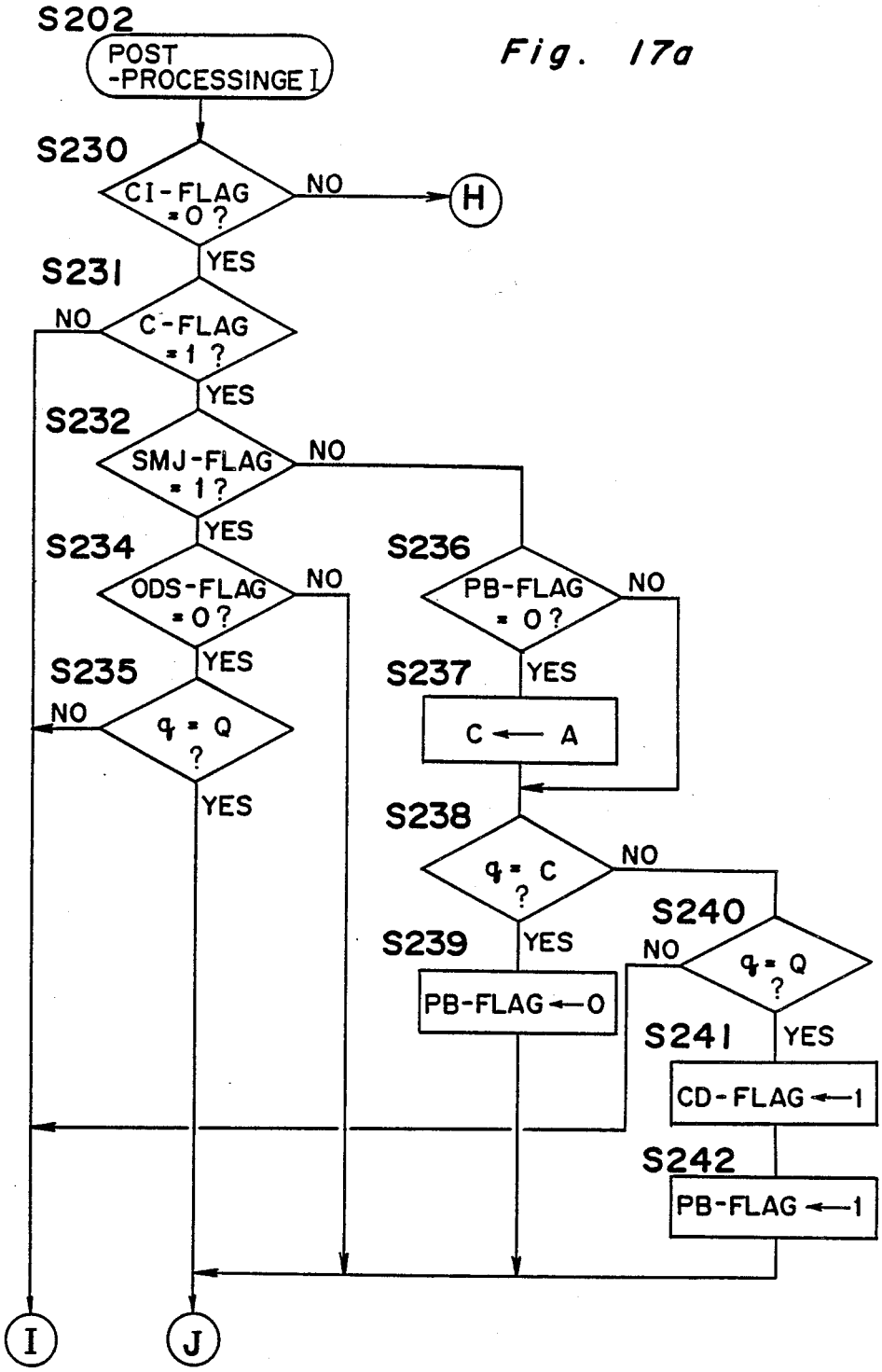
Figure 17B:
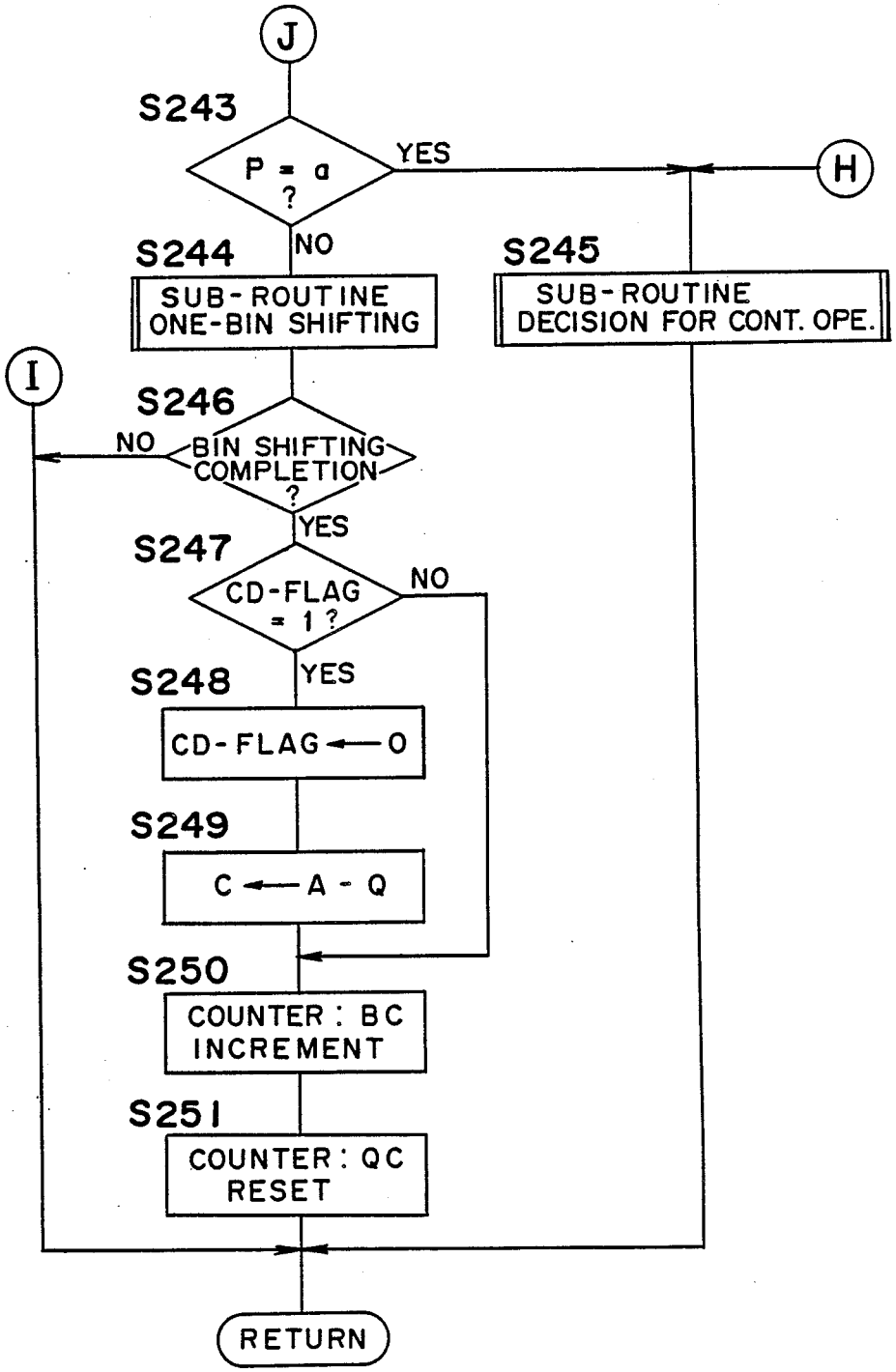
Figure 18:
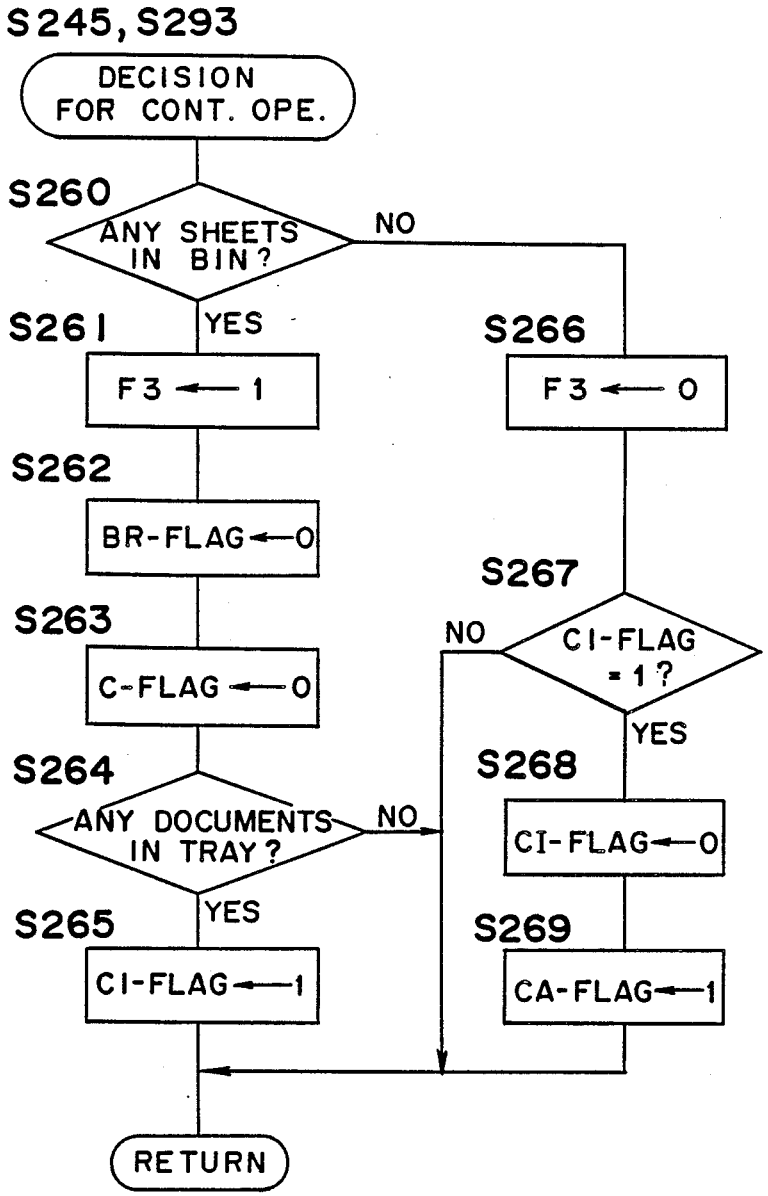
Figure 20:
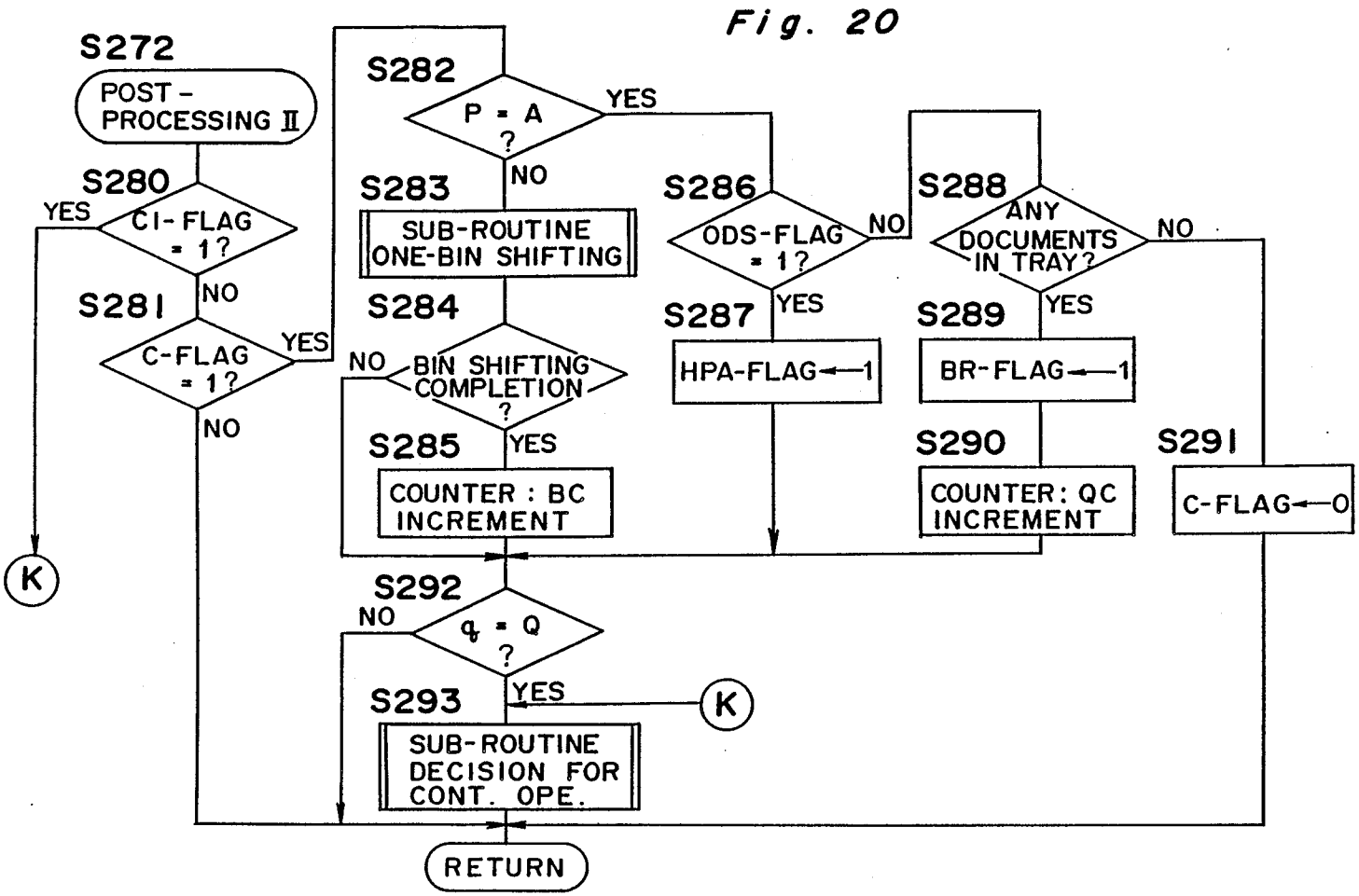

FIGS. 10 and 11 are flow-charts showing one of the subroutines in FIG. 6;

FIGS. 12 is a flow-chart showing one of the subroutines in FIG. 11;

FIG. 13 is a flow-chart showing one of the subroutines in FIG. 12;

FIG. 14 is a flow-chart showing one of the subroutines in FIG. 11;

FIG. 15 is a flow-chart showing one of the subroutines in FIG. 14 and in FIG. 19 which is described later on;

FIG. 16 is a flow-chart showing one of the subroutines in FIG. 14 and in FIG. 19 which is described later on;

FIGS. 17*a* and 17*b* are one of the two-divided flow-charts showing another subroutine in FIG. 14;

FIG. 18 is a flow-chart showing one of the subroutines in FIG. 17*b* and in FIG. 20 which is described later on;

FIG. 19 is a flow-chart showing still one of the subroutines in FIG. 11;

FIG. 20 is a flow-chart showing one of the subroutines in FIG. 19; and

Figure 21:
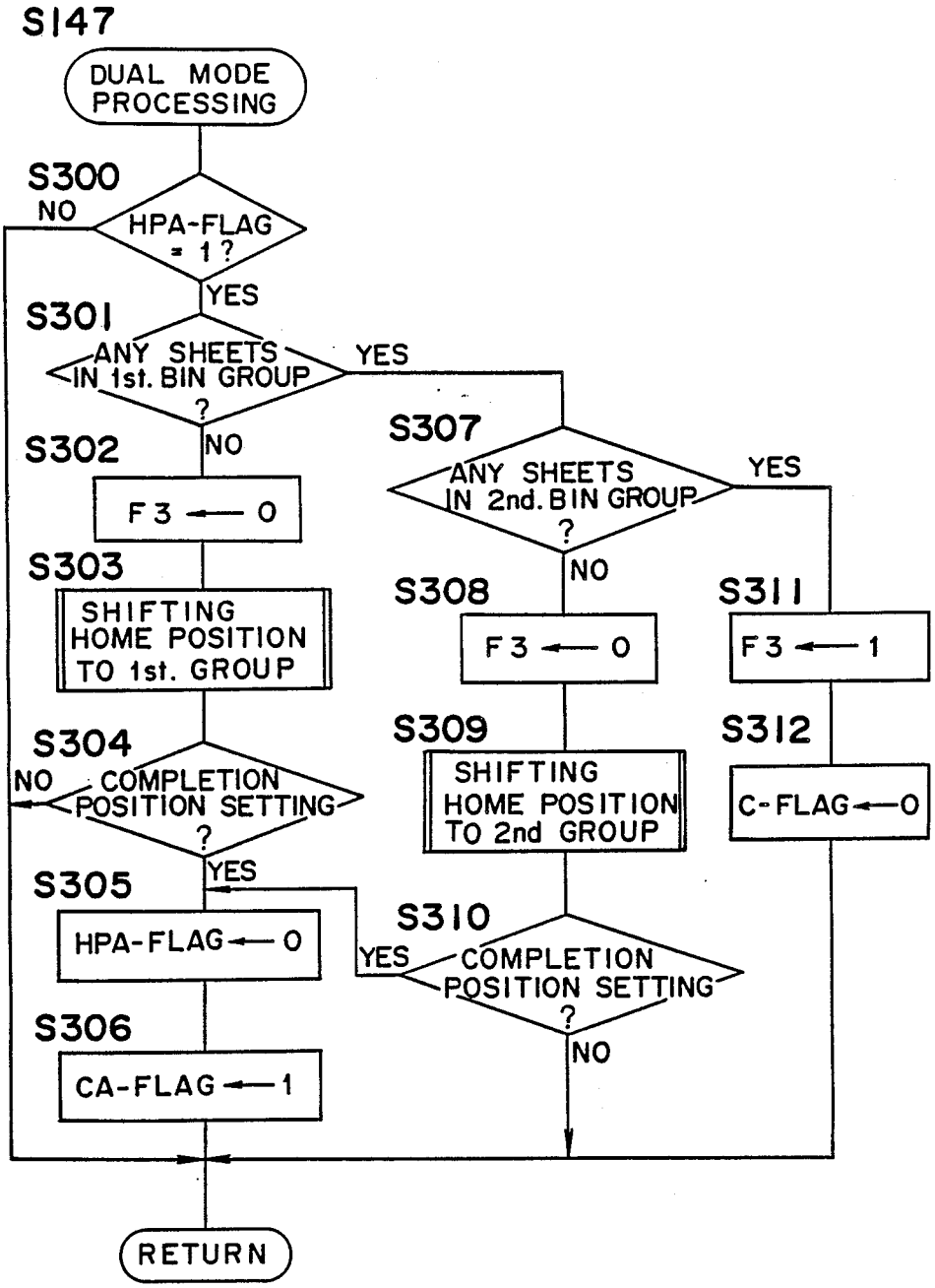

FIG. 21 is a flow-chart showing still one of the subroutines in FIG. 11.

DETAILED DESCRIPTION OF THE INVENTION

Before the description of the present invention proceeds, it is to be noted that like parts are designated by like reference numerals throughout the accompanying drawings.

Figure 1:
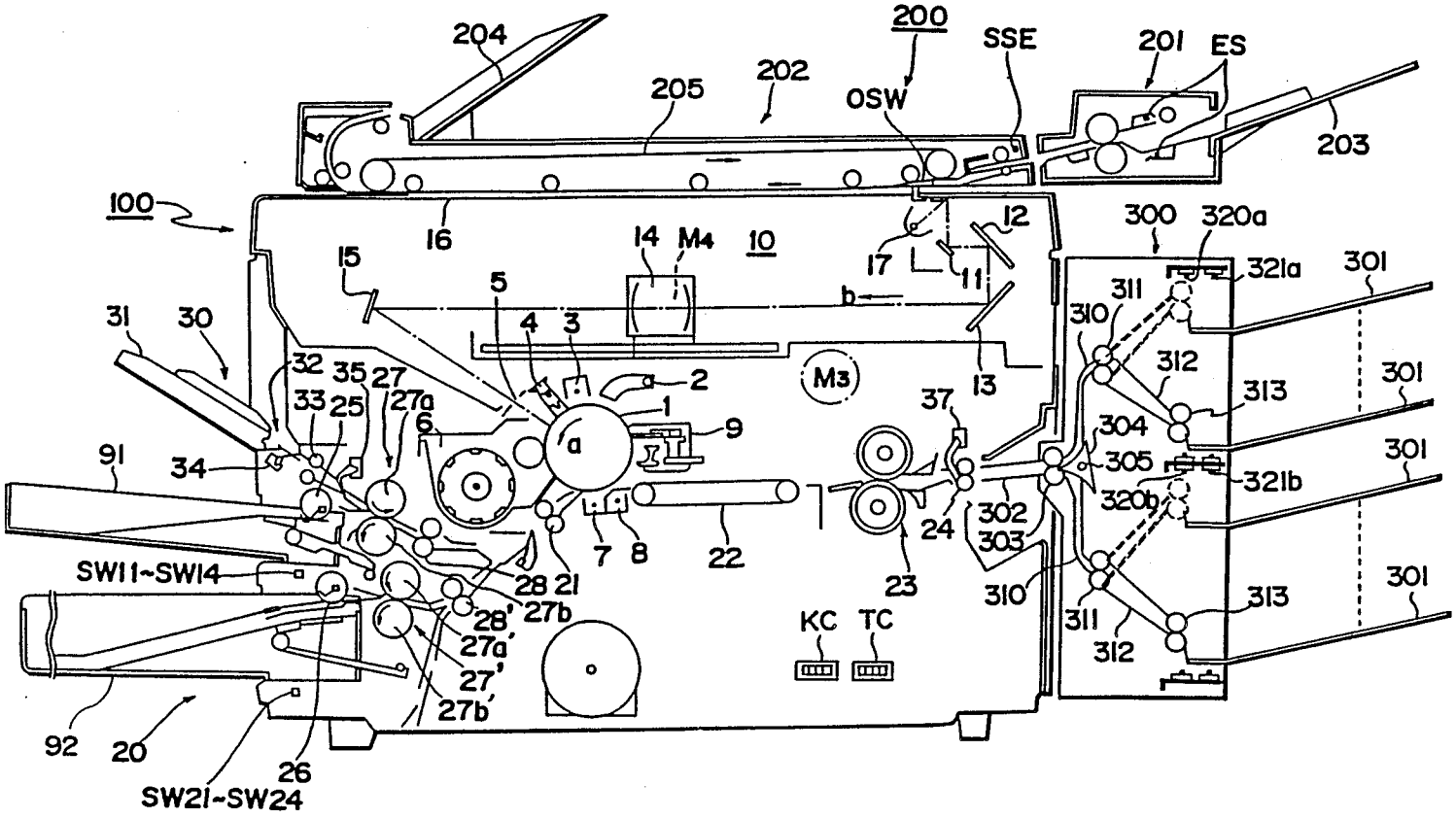
FIG. 1 is a schematic diagram of the entire construction of a copying apparatus according to one embodiment of the present invention.

Referring now to FIG. 1, there is shown a copying apparatus 100 which includes a photoreceptor drum 1 provided at approximately a central portion of an apparatus housing and supported rotatably in the direction shown by an arrow (a) in FIG. 1. Further, there are sequentially disposed various process devices such as an eraser lamp 2, a corona charger 3, an image-edge and inter-image eraser 4, a developing device 6, a transfer charger 7, a sheet separating charger 8, and a cleaning device 9 in the periphery of the photoreceptor drum 1. The photoreceptor drum 1 has a photosensitive layer formed on its outer peripheral surface, and the layer is uniformly charged by passing through the eraser lamp 2 and the corona charger 3. An electrostatic latent image is formed on the peripheral surface thereof when it is subjected to an image exposure by a scanning optical system 10 through a slit 5. The image-edge and inter-image eraser 4 includes a plurality of light emitting diodes arranged in the image width direction. The diodes remove an unnecessary electric charge from the surface of the photoreceptor drum 1 when an image is formed thereon.

The scanning optical system 10 provided below an original document-placing glass 16 (hereinafter referred to as original document glass) to scan an image of an original document comprises an exposure lamp 17, movable mirrors 11, 12, and 13, a lens assembly 14, and a mirror 15. A scan motor M3 drives the exposure lamp 17 and the movable mirror 11 in one unit so as to move both in the direction shown by an arrow (b) at a speed of (v/m) (m: copying magnification) with respect to the circumferential speed of (v) of the photoreceptor drum 1 (v is constant both in equal-size and varied magnifications) and also the movable mirrors 12 and 13 in one unit so as to move both in the direction shown by an arrow (b) at a speed of v/2m with respect to the circumferential speed of (v) of the photoreceptor drum 1. In varying a copying magnification, a stepping motor M4 drives the lens assembly 14 so that the lens assembly 14 may move along an optical axis and allows a mirror 15 to be swingably movable so as to correct the optical path. The magnification varying mechanism as described above is known. The scanning speed of the optical system 10 is controlled by the scan motor M3 whose rotational speed is changed on the basis of pre-selected data on a copying magnification. This control system is also known. Therefore, neither the detailed description of the magnification varying mechanism nor the control of the scanning speed of the optical system 10 is made.

Copy sheets are fed into the copying apparatus 100 from an automatic paper feeding mechanism 20 having upper and lower two-stage cassette mounting section provided at the left side of the copying apparatus 100 shown in FIG. 1 or from a manual paper feeding mechanism 30 provided above the automatic paper feeding mechanism 20. A copy paper sheet which has been fed into the copying apparatus 100 is stopped by a pair of timing rollers 21, then fed into the transfer section in synchronization with an image to be formed on the photosensitive surface of the photoreceptor drum 1 so that a toner image is transferred to the copy paper sheet by the transfer charger 7, and thereafter, separated from the surface of the photoreceptor drum 1 by the separating charger 8. Then, the copy paper sheet is fed by a conveyor belt 22 into a fixing unit 23 by which the toner image is fixed to the copy paper sheet, then discharged through a pair of discharge rollers 24 to a predetermined bin or bins 301 of a sorter 300, the details of which is described later. A sheet detection switch 37 detects the discharge of the copy sheet. A key counter (KC) operates at the feed timing of the copy sheet and a total counter (TC) operates at the discharge timing thereof. These counters are incremented by "1", respectively every time a copying operation is performed.

After the toner image is transferred to the photoreceptor drum 1, a toner and electric charge which have remained on the surface thereof are removed by the cleaning unit 9 and the eraser 2 so as to prepare for subsequent copying operations.

The automatic paper feeding mechanism 20 and the manual paper feeding mechanism 30 are selectively used. When the former is used, the operation of an image-forming system including the photoreceptor drum 1 is started by the operation of a print key 71 (refer to FIG. 3) to actuate the copying apparatus 100, and upon completion of the operation of the preparatory drive of the photoreceptor drum 1, a paper feeding roller 25 or 26 is driven, and then, the operation of the optical system 10 is started by a scan starting signal produced and followed by the transport of the copy paper sheet. Thus, the copy paper sheet is transported in synchronization with an image forming operation. Two or three copy paper sheets are pushed forward by the rotation of the paper feeding roller 25 or 26 and only the uppermost sheet is transported forward by loosening units 27 and 27' disposed at a stage subsequent thereto.

In the loosening mechanism 27 and 27', upper rollers *27a* and *27a'* are rotated in the direction in which the copy paper sheet is transported forward, while lower rollers *27b* and *27b'* are rotated in the direction in which the copy paper sheet is transported backward as shown by arrows. Copy paper sheets underneath the uppermost copy paper sheet which have been transported forward together with the uppermost sheet are transported backward by the lower rollers *27b* and *27b'*, and only the uppermost sheet is transported toward a pair of intermediate roller 28 or 28' disposed at a stage subsequent thereto. As will be described later, the intermediate rollers 28 and 28' are driven in association with a pair of timing rollers 21 disposed at a stage subsequent thereto.

A manual paper feeding is described hereinbelow. When a copy paper sheet fed from a manual feeding table 31 into the manual sheet feeding port 32 is detected by a sensor 34, a pair of rollers 33 are rotated to feed the copy paper sheet into the copying apparatus 100. Simultaneously with the feeding of the copy paper sheet into the copying apparatus 100 or a delay by a slight interval delayed, the image-forming system including the photoreceptor drum 1 is driven as driven by the print key described above. The copy paper sheet fed into the copying apparatus 100 through the manual paper feeding mechanism 30 is stopped at a detecting portion of a copy paper sheet-leading edge detection switch 35. When the preparatory operation including the rotation of the photoreceptor drum 1 has been completed, a pair of the sheet feeding rollers 33 resumes their rotations, whereby the copy paper sheet is fed into the copying apparatus 100.

The manual feeding table 31 is removably mounted on the copying apparatus 100 so that a general purpose paper feeding unit including a paper feeding motor and a paper feeding roller can be mounted thereon, instead of the table 31. Thus, the copying apparatus 100 may have a function equivalent to that of three-stages automatic paper feeding mechanism.

The upper and lower cassette mounting portions of the automatic paper feeding mechanism 20 are provided with paper size-detecting switches SW11 through SW14 and switches SW21 through SW24, respectively. An arrangement of projections or magnets (not shown) arranged on the cassettes 91 and 92 detects of the operation condition of the switches. Therefore, the automatic paper feeding mechanism 20 is capable of detecting the sizes of copy paper sheets attached thereto in a binary code of four bits. Various types of mechanisms for detecting the size of a copy paper sheet accommodated in a cassette are known. Accordingly, the detailed description of the above-described sheet size-detecting mechanism is omitted.

Construction and operation of automatic original document feeder

Referring to FIG. 1, the copying apparatus 100 is provided with an automatic original document feeding unit 200 (hereinafter referred to as ADF) on the top portion thereof capable of performing a copying operation in association with the copying apparatus 100. The ADF 200 comprises an original document-feeding section 201 for feeding original documents thereon one by one and an original document transport section 202 for transporting the original document fed from the original document-feeding section 201 along the surface of the original document glass 16 by means of a transport belt 205, stopping the original document at a predetermined position and discharging the original document to a sheet discharge tray 204 after it is scanned by the optical system 10. The original document transport section 202 is pivotally mounted on the top surface of the copying apparatus 100 so that it may be used as a manual original document feeding section. Therefore, the original document-transport section 202 can be used as an ordinary use of a conventional-type cover.

When the original document-transport section 202 is closed, a switch (OSW) comprising a lead switch is turned on upon detection of a magnet (not shown) mounted on the copying apparatus 100. When the original document-transport section 202 is opened, the switch (OSW) is turned off. When the switch (OSW) is turned on, the ADF 200 and the copying apparatus 100 are interlocked with each other, i.e., the operation mode of the copying apparatus 100 can be switched to the ADF mode. The operation of the ADF mode is described hereinbelow. When an ADF start key 401 (refer to FIG. 4) is pressed, the ADF 200 starts its operation with the copying apparatus 100 maintained in a stand-by state, feeds an original document placed lowermost on an original document-placing tray (hereinafter referred to original document tray) 203 along the surface of the original document-placing glass 16. When the original document is moved to a predetermined position, it is stopped and at this time, the ADF 200 outputs a starting signal to the copying apparatus 100, whereby the above-described copying operation is started. When the optical system 10 completes the scanning of the original document, the copying apparatus 100 outputs an operation signal to the ADF 200, whereby the original document is discharged to the sheet discharge tray 204. At this time, a subsequent original document placed on the original document tray 203 is transported to a predetermined position.

When an original document is placed on the original document tray 203, it is detected by an original document empty sensor (ES). Therefore, as long as it is detected that an original document is on the original document tray 203, the copying operations of the original documents are successively performed in the ADF mode. Original documents sequentially fed from the original document-feeding section 201 are detected by an original document detecting sensor (SSE).

Figure 2:
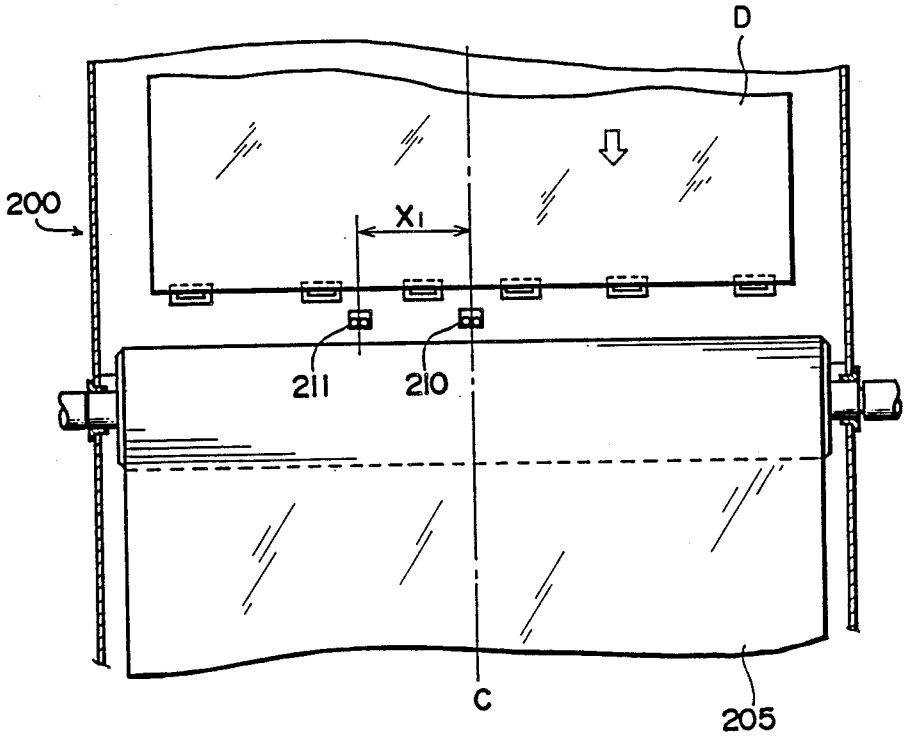
FIG. 2 is a plan view showing the original document-feeding section in an automatic document feeder provided for the copying apparatus shown in FIG. 1.

The ADF 200 includes means for automatically detecting the size of an original document. FIG. 2 shows the principal portion of an original document feeding section of the ADF 200 on which original document-detecting sensors 210 and 211 (hereinafter referred to as original document sensor) which detect the size of a sheet-type original document (D) are mounted as shown in FIG. 2. In this example, the reference position of the original document feeding unit and the optical system 10 are set in the center (center in the direction perpendicular to the direction in which the original document (D) is transported) of the original document (D). The reference position is shown by one-dot chain line (C).

The original document sensors 210 and 211 are known reflection type-photosensors comprising light emitting elements and light receiving elements. Specifically, light emitted from the light emitting element is reflected from an original document fed from the original document tray 203 and incident on the light receiving element, with the result that an output of the light receiving element changes. Thus, the original document (D) can be detected.

The original document sensor 210 provided on the reference line (C) detects the original document (D) fed from the original document feeding section 201 irrespective of the size of the original document (D). The original document sensor 211 is spaced at an interval of $X_1$ from the reference line (C) in the width direction (perpendicular to the original document transporting direction) of the original document (D). Any of the original document (D) cannot be detected by the original document sensor 211 due to its size. The discrimination of the size of the original document can be effected as follows: When the original document is detected by the original document sensor 210, a timer (t) counts pulse signals with a predetermined pitch. According to this embodiment, the length of the original document in the transport direction can be discriminated in accordance with a relationship between the actual length thereof and the number of pulses counted by the timer (t) which counts the pulse signals with a predetermined pitch.

The size of the original document (D) is detected by the numerical value counted by the timer (t) and the signal outputted from the sensor 211 according to the signal thereof. At this time, the operation of the optimum size of a copy paper sheet in accordance with the size of the original document (D) is performed.

More specifically, the size of cut sheet employed in Japan is classified into (A) size {longer side (length) of A1 (largest size): 840 mm; its shorter side (width): 594 mm} and (B) size {longer side of B1: 1,028 mm; its shorter side: 728 mm} in accordance with JIS (Japanese Industrial Standard). For example, the shorter side of an A4 sized-sheet equals the longer side of an A5-sized sheet, and the shorter side of the A5-sized sheet equals the longer side of an A6 sized-sheet, i.e., the area of an A5-sized sheet is one half of that of an A4-sized sheet; the area of an A6-sized sheet is one half of that of an A5-sized sheet. Similarly, in the case of a B-sized sheet, the shorter side of a B5-sized sheet equals to the longer side of a B6 sized-sheet. Generally, the largest size of an original document to be copied in copying apparatuses is an A3-sized sheet. Accordingly, the size of an original document glass of a copying apparatus is set to correspond to the size of the A3-sized sheet in the longitudinal direction thereof, namely, the longer side of the A3-sized sheet. In other words, the A3-sized sheet and a B4-sized sheet (the second greatest size to be used in the copying apparatus as original documents) are transported only in the longitudinal direction thereof. Therefore, each of the sizes of sheets of these two sizes can be distinguished from sheets of other sizes by detecting only the length thereof in the direction in which sheets of these two sizes are transported. However, sheets in other sizes are transported in a copying apparatus lengthwise or widthwise depending on copying apparatuses. Accordingly, merely the detection of the length of sheets in a sheet transport-direction does not allow the discrimination of the size thereof. For example, when a sheet of A4 size (297×210 mm) is transported widthwise, the timer (t) detects that the width thereof is 210 mm. When a sheet of A5 (210×148 mm) size is transported lengthwise, the timer (t) detects that the length thereof is also 210 mm. Thus, it is impossible to discriminate whether a sheet transported on the original document glass is an A4 size or an A5 size. Similarly, it is impossible to discriminate whether a sheet transported on the original document glass is an A5-sized sheet or an A6-sized sheet when the former is transported widthwise and the latter is transported lengthwise. It is also impossible to discriminate whether a sheet transported thereon is a B5-sized sheet or a B6-sized sheet when the former is transported widthwise and the latter is transported lengthwise.

Accordingly, the size of a sheet can be detected by the sensor 211 spaced at an interval of ($X_1$) from the center (reference) line of the original document transport section 202 regardless of whether it is transported lengthwise or widthwise. The table shown below indicates how the size of sheets is discriminated by the relationship between the numerical values counted by the timer (t) and the ON and OFF of the sensor 211 when an A3-sized sheet is transported widthwise and an A6-sized sheet is transported lengthwise, and a B4-sized sheet is transported widthwise and a B6-sized sheet is transported lengthwise.

TABLE

| | counted value $C_0$ of timer (t) (sensor (210)) | sensor (211) | No. |
|---|---|---|---|
| A3: length (420 × 297) | $C_0 \infty t_1 = 420/v$ | 297/2 ON | 1 |
| A4: length (297 × 210) | $t_2 = 297/v$ | 210/2 ON | 2 |
| A4: width | $t_3 = 210/v$ | 297/2 ON | 3 |
| A5: length (210 × 148) | $t_3 = 210/v$ | 148/2 OFF | 4 |
| A5: width | $t_4 = 148/v$ | 210/2 ON | 5 |
| A6: length (148 × 257) | $t_4 = 148/v$ | 105/2 OFF | 6 |
| A6: width | $t_5 = 105/v$ | 148/2 OFF | 7 |
| B4: length (364 × 257) | $t_6 = 364/v$ | 257/2 ON | 8 |
| B5: length (257 × 182) | $t_7 = 257/v$ | 182/2 ON(OFF) | 9 |
| B5: width | $t_8 = 182/v$ | 257/2 ON | 10 |
| B6: length (182 × 129) | $t_8 = 182/v$ | 129/2 OFF | 11 |
| B6: width | $t_9 = 129/v$ | 182/2 OFF | 12 |

where v: original document feeding speed

Referring to the Table, the sensor 211 is mounted on the ADF 200 to satisfy the following relationship:

$$74 \text{ mm} < X_1 < 105 \text{ mm}.$$

As described above, it is understood from the table that an A3-sized and B4-sized sheets can be distinguished from each other only by the numerical value counted by the timer (t). Similarly, when A4-sized and B5-sized sheets are transported lengthwise and when A6-sized and B6-sized sheets are transported widthwise, they can be distinguished from each other, respectively only by the values counted by the timer (t) if the sizes of the sheets are standard. In order to discriminate the sizes of sheets from each other regardless of whether they are transported lengthwise or widthwise, the position of the sensor 211 is set so that the output state, namely, ON or OFF of the sensor 211 is differentiated according to the sizes which coincide with each other in respect of the numerical values counted by the timer (t).

As understood from the above table, the biggest sheet size which causes the sensor 211 to turn off is A5 when it is transported lengthwise. The distance between the sensor 211 and the center reference line (C) is 74 mm. Therefore, the condition of 74 mm $< X_1$ is satisfied. The smallest sheet size which causes the sensor 211 to turn off is A5 when it is transported widthwise. The distance between the sensor 211 and the center reference line (C) is 105 mm. The condition of $X_1 < 105$ mm is satisfied in this case as well. The sheet sizes shown in the table are standard ones, but actually, sizes of sheets are mostly larger or smaller than the standard sizes by $-1$ mm or $+1$ mm. Therefore, it is necessary to set the numerical values to be counted by the timer (t) and the distance ($X_1$) in consideration of such an error. In a copying apparatus in which an original document is transported along one side of an original document transport portion, it is necessary for the sensor 211 to satisfy the following condition: 148 mm $< (X_2) <$ 210 mm so that sheet sizes shown in the above table and adopted in Japan are distinguished from each other.

The data of detected sizes of original documents according to the values counted by the timer (t) and the output state !ON or OFF) of the sensor is stored in a memory of a microcomputer. An optimum size of a copy paper sheet is determined by this data and copying magnification data inputted by a user and stored in the memory. The description of the mechanism for selecting the optimum copy paper sheet size is omitted. In addition to the above, various means for detecting the size of an original document are considered. For example, the sensor may be provided for the optical system 10 so as to detect the size of the original document.

Detection of boundary between units of originals

In the ADF 200 having the above-described construction, the insertion of a partitioning sheet whose size differs from the size of original documents of units of originals between units of originals allows the boundary therebetween to be distinguished from each other. That is, the data of the size is stored in the memory of the microcomputer computer for each detection of each size of original documents so as to be compared with the size of a sheet subsequently detected. If it is detected that the size of the sheet subsequently detected is different from that of the preceding sheet, the former is decided that it is the partitioning sheet inserted between units of originals. In this case, when the first sheet of the following unit of originals is supplied to the ADF 200, it is decided that the size of the first sheet of the following unit of originals is different from that of the partitioning sheet detected previously. Thus, if it happens that two sequential judgements on the sheet size detection are negative (the different size is sequentially detected two times), it is decided that the second sheet supplied to the ADF 200 is not a partitioning sheet, but the first sheet of the following unit of originals. Namely, it is not decided on that occasion that the boundary is detected. To this end, the ADF 200 is provided with a counter for automatically counting the number of original documents. A sheet detected immediately after the ADF 200 starts its operation is decided that it is an original document because it is unnecessary to place a partitioning sheet on top of a unit of originals.

The following sheets can be used as a partitioning sheet to be inserted between units of originals.

(1) If original documents of units of originals are A-sized, a B-sized sheet is inserted therebetween.

(2) If original documents of units of originals are A-sized, a sheet whose width is A-sized and whose length is B-sized is inserted therebetween. According to the embodiment, the original documents are transported with its center coinciding with the center line of the original document transport section. Therefore, unless the width of a partitioning sheet equals to the width of the original document, the partitioning sheet may be transported obliquely with respect to the center line of the original document transport section because the partitioning sheet is not regulated by a side guide plate. So a sheet selection as described above is advisable.

(3) If original documents of units of originals are A-sized, an A-sized sheet whose size is different from that of the original documents is inserted therebetween. For example, a sheet of A3 size is inserted between units of originals if original documents are A4-sized or if original documents of A4 size are transported lengthwise, a sheet of A4 size is transported widthwise.

(4) A cutout is formed on a sheet whose size is the same as those of units of originals. This causes original document-size detecting sensor 211 to turn on with a certain period delayed. As a result, the size of the sheet is substantially different from those of the original documents.

The method for controlling the detection of a boundary between units of originals is described together with the operation control of a sorter 300 with reference to flowcharts.

Construction of sorter and operation thereof

In FIG. 1, the sorter 300 is mounted on a copy sheet discharge section of the copying apparatus 100 and distributes copy sheets discharged therefrom to bins 301 Twenty bins 301 are mounted on the sorter 300, i.e,, the upper portion thereof is provided with 10 bins as a first group and the lower portion thereof is provided with 10 bins as a second group.

More specifically, the sheet feeding section of the sorter 300 comprises a pair of upper and lower feeding guide plates 302 which confront a pair of discharge rollers 24 provided in the copying apparatus 100, a pair of feeding rollers 303, and a sheet-deflecting claw 304. The sheet-deflection claw 304 pivotable on a pin 305 distributes copy sheets discharged from the copying apparatus 100 to the first group bins 301 or to the second group bins 301. Each of upper and lower sheet-transport sections comprises a guide plate 310, a pair of transport rollers 311, a swingable guide plate 312, and a pair of discharge rollers 313. A pair of discharge rollers 313 is movable by one step to positions for discharging copy sheets to each of the 10 bins 301. In association with the vertical movement of a pair of the discharge rollers 313, the guide plates 312 swing about a pin disposed in the vicinity of a pair of transport rollers 311 and the interval between a bin 301 to which copy sheets are discharged and a bin 301 disposed one step higher is widened. A pair of the discharge rollers 313 is moved by a spiral cam. The variation of the interval between adjacent bins 301 is adjusted by the combination of a floating cam partially cut away and a trunnion provided on both sides of each bin 301.

The sorter 300 is provided with two pairs of transmission type-photosensors **320*a*, 320*b* and 321*a*, 321*b* comprising light emitting elements and light receiving elements. The first sensors 320*a* and 320*b* detect that copy sheets have been sequentially discharged from a pair of the discharge rollers 313 to the first group of bins 301 and the second groups of bins 301, respectively. The second sensors 321***a* and 321*b* detect whether or not the first group of bins 301 and the second group of bins 301 are empty, respectively.

Operation mode of sorter

The sorter 300 constructed as above is essentially capable of accommodating copy sheets in three modes, namely, non-sorting mode, sorting mode, and grouping mode. In addition to these three modes, the sorter 300 operates as two sorters because the sorter 300 is provided with two groups of bins which function independently of each other. These operation modes are also controlled in response to the detection of a partitioning sheet effected by the ADF 200.

The non-sorting mode means that all copy sheets discharged from the copying apparatus 100 are accommodated in the uppermost bin 301 of the first group of bins. In the sorting mode, the number of bins to which copy sheets per one original document are distributed sheet by sheet coincides with the number of copies set by an operator. In this mode, copy sheets are piled in order of page. The grouping mode means that copy sheets corresponding to a predetermined number of copies are distributed from bin to bin 301 sequentially for every one original document.

Copy sheets are distributed from the first (upper) group of bins to the second (lower) group of bins in the sorting and grouping modes. Accordingly, as shown by broken lines in FIG. 1, when the sorter 300 starts its operation, each guide plate 312 is set to take his home position. The home position means a position that the copy sheet can be discharged to the uppermost bins 301 of the first (upper) and second (lower) groups through the guide plate 312. When the first (upper) group of bins are all full of copy sheets, remaining copy sheets are distributed to the second (lower) group of bins, i.e., copy sheets can be accommodated in 20 bins.

The sorter 300 may be used in such a manner that two groups of bins consisting of 10 bins, respectively operate independently of each other. Such an operation mode is hereinafter referred to as dual mode. For example, when copy sheets of two units of originals are discharged from the copying apparatus 100, the copy sheets of a first unit of originals are sorted by the bins of the first (upper) group and those of a second unit of originals are sorted by the bins of the second (lower) group. If copy sheets of more than two units of originals are discharged from the copying apparatus, copy sheets are removed from bins to which all of a predetermined number of copy sheets have been distributed. Thus, copy sheets for subsequent units of originals are distributed to the bins from which the copy sheets for preceding units of originals have been removed, which enables copying operations successively.

According to the embodiment, when the images of two units of originals or more are copied, the copying mode thereof can be preset and a signal indicative of a copy start operation enables the copyings of the respective units of originals. The control according to such a reserved system is referred to as multi-job. Further, when a predetermined number of sheets to be copied (referred to as "number of copies" hereinafter) for a plurality of units of originals is set to "1", copy sheets of one unit of originals are automatically accommodated in one bin 301. Such a system is referred to as single multi-job.

The above-described controls are effected by the ADF 200 which detects the partitioning sheet whose size differs from the size of original documents of the unit of originals.

Figure 3:
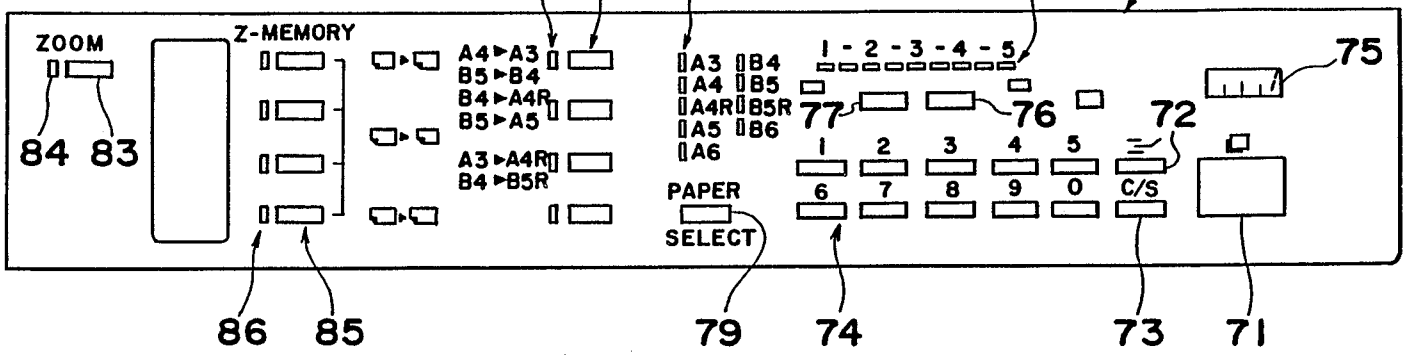
FIG. 3 is a plan view showing an arrangement of an operation panel provided for the copying apparatus shown in FIG. 1.
Figure 4:
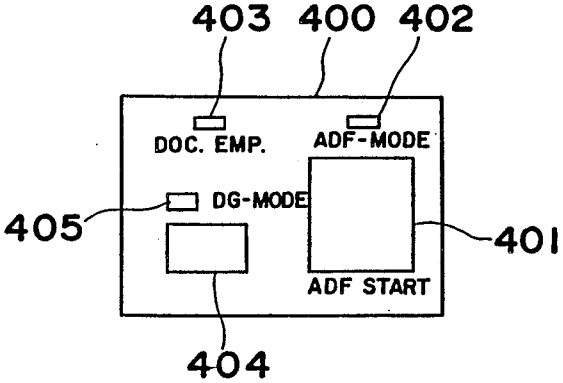
FIG. 4 is a plan view showing an arrangement of an operation panel of the automatic document feeder mounted thereon.
Figure 5:
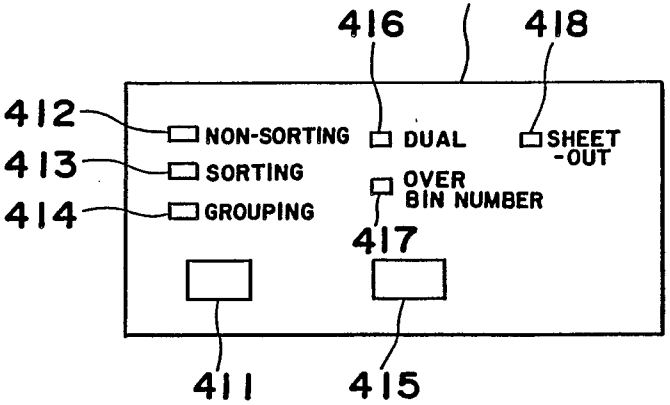
FIG. 5 is a plan view showing an arrangement of an operation panel of a sorter mounted on the copying apparatus.

As shown in FIGS. 3, 4, and 5, operation panels provided in the embodiment includes a copying apparatus panel 70, an ADF panel 500, and a sorter panel 410.

As shown in FIG. 3, the copying apparatus panel 70 disposed on the top forward portion of the copying apparatus 100 is provided with a print key 71 for starting a copying operation when the ADF 200 is not used, an interruption key 72 for temporarily stopping a multi-copying operation, a clear/stop key 73 for stopping a copying operation and releasing a predetermined number of copies, ten-keys 74 for setting the number of sheets to be copied in carrying out a multi-copy, an indication portion 75 for indicating the number of sheets to be copied and the condition of the copying apparatus 100, an up-down keys 76 and 77 for setting an image density, indication LEDs 78 for indicating the image density, sheet selecting key 79 for selecting the size of copy sheets, indication LEDs 80 for indicating the result selected by the sheet selecting key 79, magnification selecting keys 81 for selecting a copying magnification from preset magnifications, magnification indication LEDs 82 for indicating a selected magnification, a selection key 83 for presetting and selecting a zoom magnification, an indication LED 84 for indicating the selection made by the selecting key 83, keys 85 for presetting and selecting a zoom magnification, and LEDs 86 for indicating the selection made by the keys 85. Information on the stoppage of the copy sheet halfway in the copying apparatus 100 and a toner-empty is indicated on top of the print key 71, additionally.

As shown in FIG. 4, the ADF panel 400 mounted on the top surface of the ADF 200 is provided with an ADF start key 401 for starting a copying operation to be performed in unison with the ADF 200, an LED 402 for indicating that the copying apparatus 100 is operating in the ADF mode, an original document empty-display LED 403 for indicating that the original document tray 203 is empty, a selection key 404 for instructing the ADF 200 to execute an original document boundary detection mode, and an LED 405 for indicating that this mode has been selected.

The selection key 404 (original document boundary detection mode key) is switched to a selection and a release each time the key 404 is pressed. When original document boundary detection mode is selected, the LED 405 flashes.

As shown in FIG. 5, the sorter panel 410 is provided with a selection key 411 for selecting the operation mode of the sorter 300, a non-sorting mode display LED 412 and a sorting mode display LED 413 and a grouping mode display LED 414 for indicating a selected operation mode of the sorter 300, a dual mode selection key 415 and an indication LED 416 for indicating the selection made by the dual mode selection key 415, an LED 417 for indicating that the selected number of copy quantity exceeds the number of the bins mounted on the sorter 300, and an LED 418 for indicating the removal of copy sheets from bins 301.

In the initial state, an operation mode of the sorter 300 is set to the non-sorting mode. Every time the mode selection key 411 is pressed, the modes are sequentially switched to the sorting mode, the grouping mode, and the non-sorting mode, and the LEDs 412, 413 and 414 corresponding thereto, respectively flash. The dual mode selection key 415 is alternately switched to a selection and a release every time it is pressed. The LED 416 flashes when the dual mode has been selected.

Control procedure

The control procedure of the copying apparatus having the above-described construction is described hereinbelow.

FIG. 6 shows the main routine of the microcomputer (hereinafter referred to as CPU) which is the main control unit of the operation of the copying apparatus. Although not shown in the drawing, various switches, sensors, actuators and control circuits of the copying apparatus 100 of the ADF 200 and the sorter 300 are connected to the input-output port of the CPU.

In FIG. 6, when the CPU is reset and the program starts, at step S1, the random access memory (hereinafter referred to as RAM) is cleared, registers are initialized, and the initialization is effected to set the respective devices of the copying apparatus to the initial mode. Thereafter, at step S2, the operation of the main timer contained in the CPU is started. The main timer determines the period of time required for the main routine to perform its function, and the value counted thereby is preset at step S1 when the initialization is performed.

At steps S3 through S6, the respective subroutines whose details are described later are sequentially called and when the processings of all of the subroutines are terminated, the program waits for the termination of counting of the main timer at step S7, and then, the program returns to step S2. Using the period of time for one routine to require, the countings of various kinds of timers to be used in the respective subroutine are effected. That is, whether or not the counting of the timer is stopped in the respective subroutines is decided by the number of countings of one routine effected by corresponding timers.

FIGS. *7a* through *7f* show the subroutine of an input processing to be executed at step S3.

In FIG. *7a*, at step S20, it is decided whether or not a flag on boundary of units of originals (ODS-flag) has been set to "1". When a boundary between units of originals is detected by the ADF 200, i.e., when it is discriminated that a partitioning sheet has been detected, the flag on boundary of units of originals (ODS-flag) (refer to step S184 in FIG. 13) is set to "1". If the ODS-flag has been set to "1", the data of the input condition of a copying mode with respect to a subsequent unit of originals stored in the RAM is called at step S21 to display the data. At step S22, a memory flag (M-flag) is reset to "0". When the copying mode is stored in the RAM, the memory flag (M-flag) is set to "1" (refer to step S54 in FIG. 7.)

At step S23, a predetermined number (A) of copies inputted through one of the ten-keys 74 is set, then, at step S24, the subroutine for a copy paper sheet selection is executed to set a selected size of a copy paper sheet. At step S25, the data of other conditions inputted to the input port of the CPU with respect to the operation of the copying apparatus 100 are executed and a selected mode is set.

At step S26, it is decided whether or not a copy flag (C-flag) has been reset to "0". The copy flag (C-flag) is kept set to "1" during a copying operation. If the copy flag (C-flag) has been set to "1", the program goes to step S35 immediately. If the copy flag (C-flag) has been reset to "0", the operation mode of the ADF 200 is accepted at step S27 through step S34.

That is, at step S27, it is decided whether or not the original document empty sensor (ES) is at ON edge. If the empty sensor (ES) is at ON edge, i.e., if units of originals have been placed on the original document tray 203, a warning flag (F2) is reset to "0" at step S28. When no original documents are placed on the original document tray 203 on pressing the ADF start key 401, the warning flag (F2) is set to "1" (refer to steps S71 and S73). Subsequently, it is decided at step S29 whether or not the memory flag (M-flag) has been set to "1". If the memory flag (M-flag) has been set to "1", similarly to step S21 and step S22, data on the copy mode condition of the subsequent unit of originals stored in the RAM is set at steps S30 and S31, and the memory flag (M-flag) is reset to "0". Next, at step S32, it is decided whether or not an original document is placed on the original document tray 203 according to the ON or OFF of the sensor (ES). If it is detected that the original document is found thereon, an ADF mode flag (ADF-flag) is set to "1" at step S33, and if the original document is not found thereon, the ADF mode flag (ADF-flag) is reset to "0" at step S34. When the ADF mode flag (ADF-flag) is set to "1", the ADF 200 is capable of performing a copy operation.

In FIG. *7b*, the selection and release of units of originals boundary detection mode (DG-mode) are effected at step S35 through step S39. When the units of originals boundary detection mode (DG-mode) is selected, both the first and second groups of bins are operated by the sorter 300, i.e., the multi-job is performed. If it is verified at step S35 that the copy flag (C-flag) has been reset to "0", it is decided at step S36 whether or not the unit of originals boundary detection mode selection switch (DG-mode SW) 404 is at an ON edge. If the DG-mode SW 404 is at ON edge, it is decided at step S37 whether or not a flag on units of originals boundary detection mode (DG-flag) has been reset to "0". If the DG-flag has been reset to "0", the DG-flag is set to "1" at step S38. If the units of originals boundary detection mode flag (DG-flag) has not been reset to "0", it is reset to "0" at step S39.

Next, at step S40, the subroutine for setting the sorting mode is executed, which is described in detail referring to FIG. 9 later.

At step S41 through step S57 in FIG. *7c*, the data of the selection of the dual mode, the release thereof, and the inputted data of the copy mode of a second unit of original in performing a multi-job are stored. However, these data are not accepted during a copying operation. That is, after verifying that the copy flag (C-flag) has been reset to "0" at step S41 (if the C-flag has been set to "1", the program immediately goes to step S58), it is decided whether or not the dual mode selection switch (DU-mode SW) 415 is at ON edge. If the DU-mode SW is at ON edge, it is decided whether or not the units of originals boundary detection mode flag (DG-flag) has been set to "1" at step S43. If no operation has been made, the program goes to step S58. When the units of originals boundary detection mode has not been selected, it is decided at step S44 whether or not the sorting mode flag (S-flag) has been set to "1". If the sorting mode flag (S-flag) has been set to "1", it is decided whether or not the dual mode flag (DU-flag) has been reset to "0". If the DU-flag has been reset to "0", the DU-flag is set to "1" at step S46 and if the DU-flag has not been reset to "0", the DU-flag is reset to "0" at step S47.

If it is decided at step S43 that the units of originals boundary detection mode (DG-mode) has been selected, it is decided whether or not the memory flag (M-flag) has been reset to "0" at step S48. If the M-flag has been set to "1", the program goes to step S58, and if the M-flag has been reset to "0", at steps S49 and S50, it is verified that the sorting mode flag (S-flag) and the ADF mode flag (ADF-flag) are set to "1", then, at step S51, it is decided at step S51 whether or not the predetermined number (A) of copies is less than a/2 (a: number of bins). If the predetermined number (A) of copies is not less than a/2, i.e., if the number (A) of copies is more than a/2 of each of the upper and lower groups of bins (10 bins, respectively in this embodiment) in the sorting mode, the warning flag (F1) is set to "1" at step S57. The warning flag (F1) is used to flash the LED 417 for indicating that the number of copies set exceeds a predetermined number of bins. If the number (A) of copies is less than a/2, the warning flag (F1) is reset to "0" at step S52, and the dual mode flag (DU-flag) is set to "1" at step S53, and the memory flag (M-flag) is set to "1" at step S54. Subsequently, the copy condition currently selected is stored by the RAM at step S55, and at step S56, the copy condition is returned to the initial condition, then, the program goes to step S58.

Figure 7A:
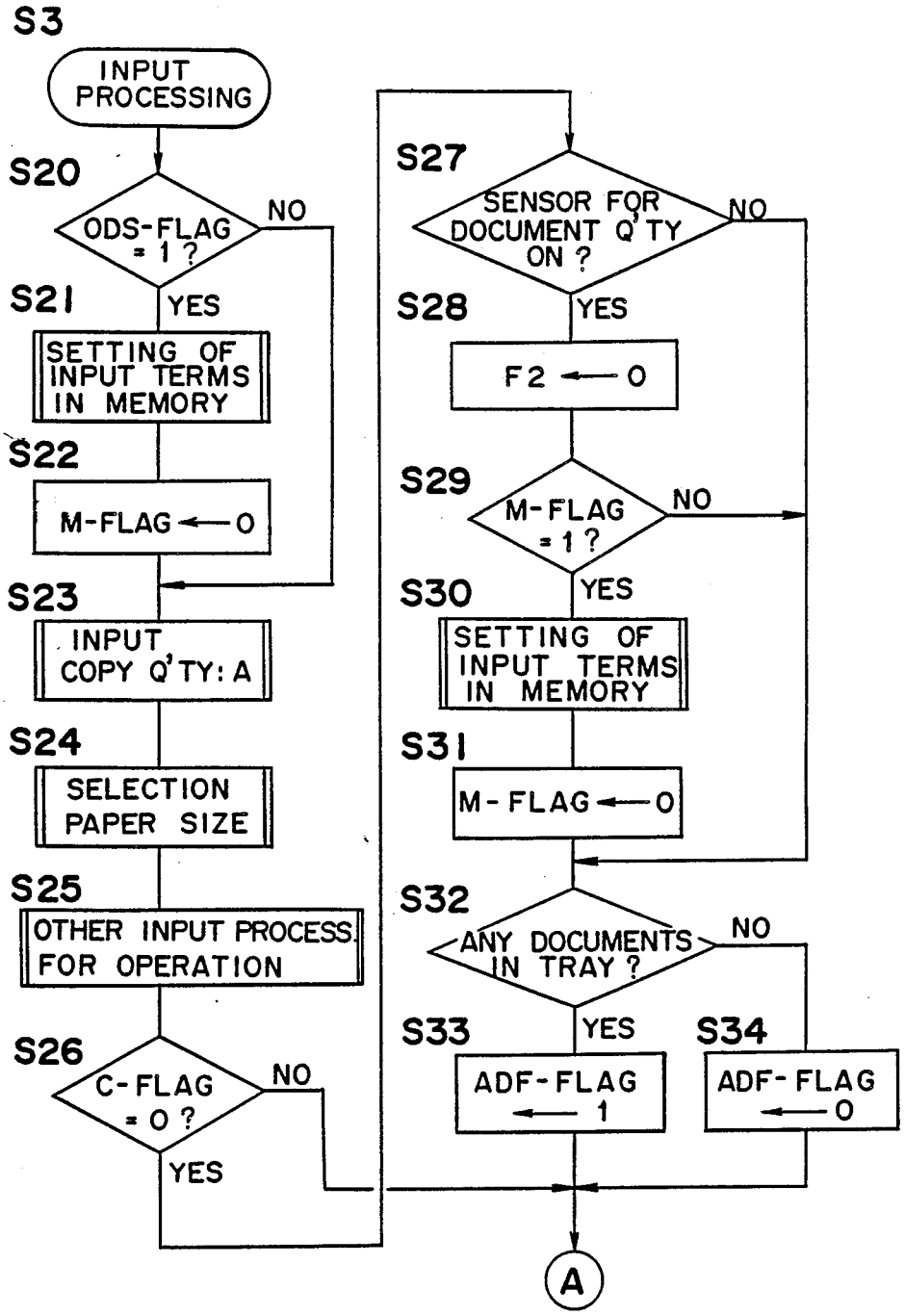
Figure 7B:
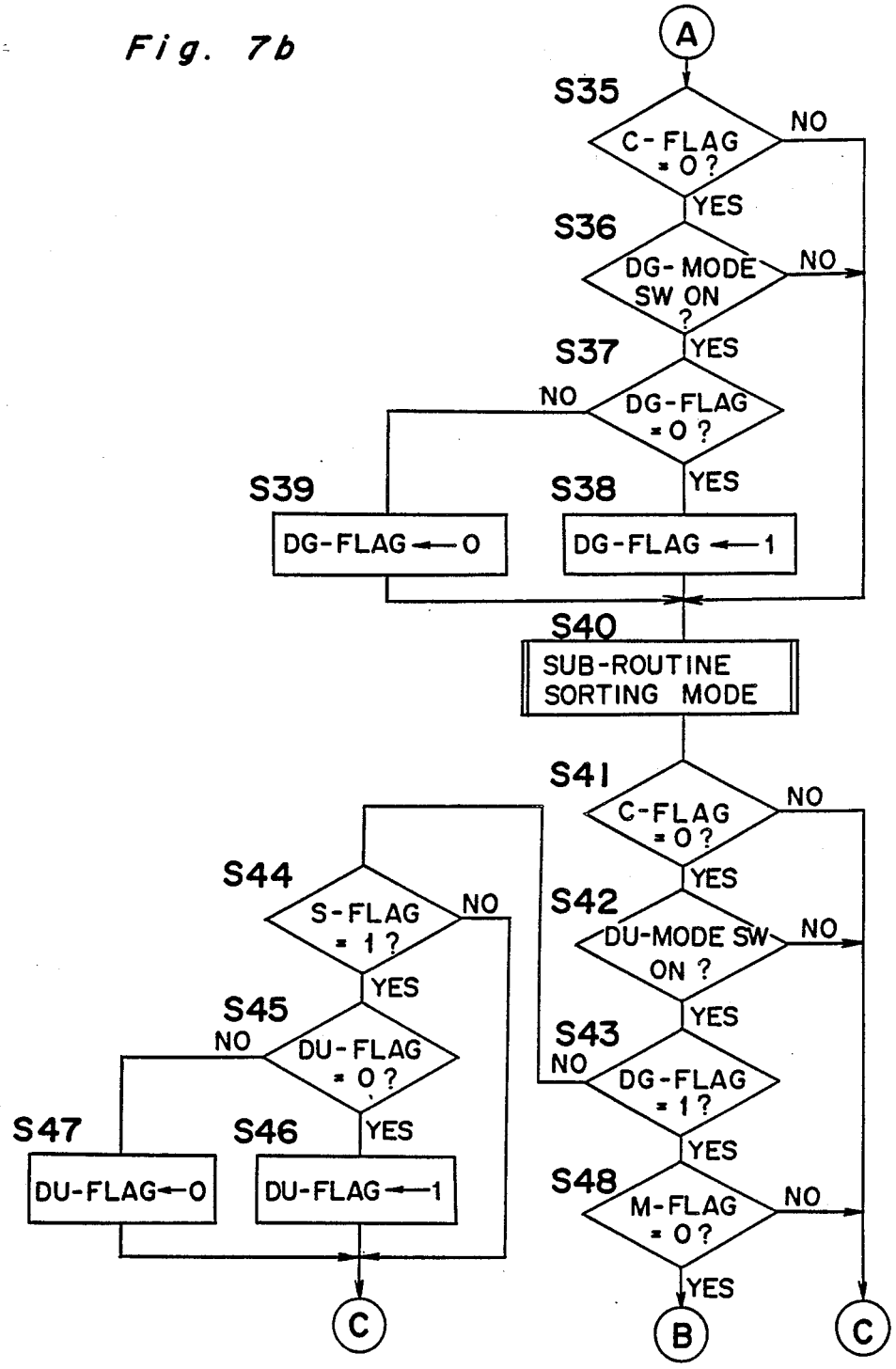
Figure 7C:
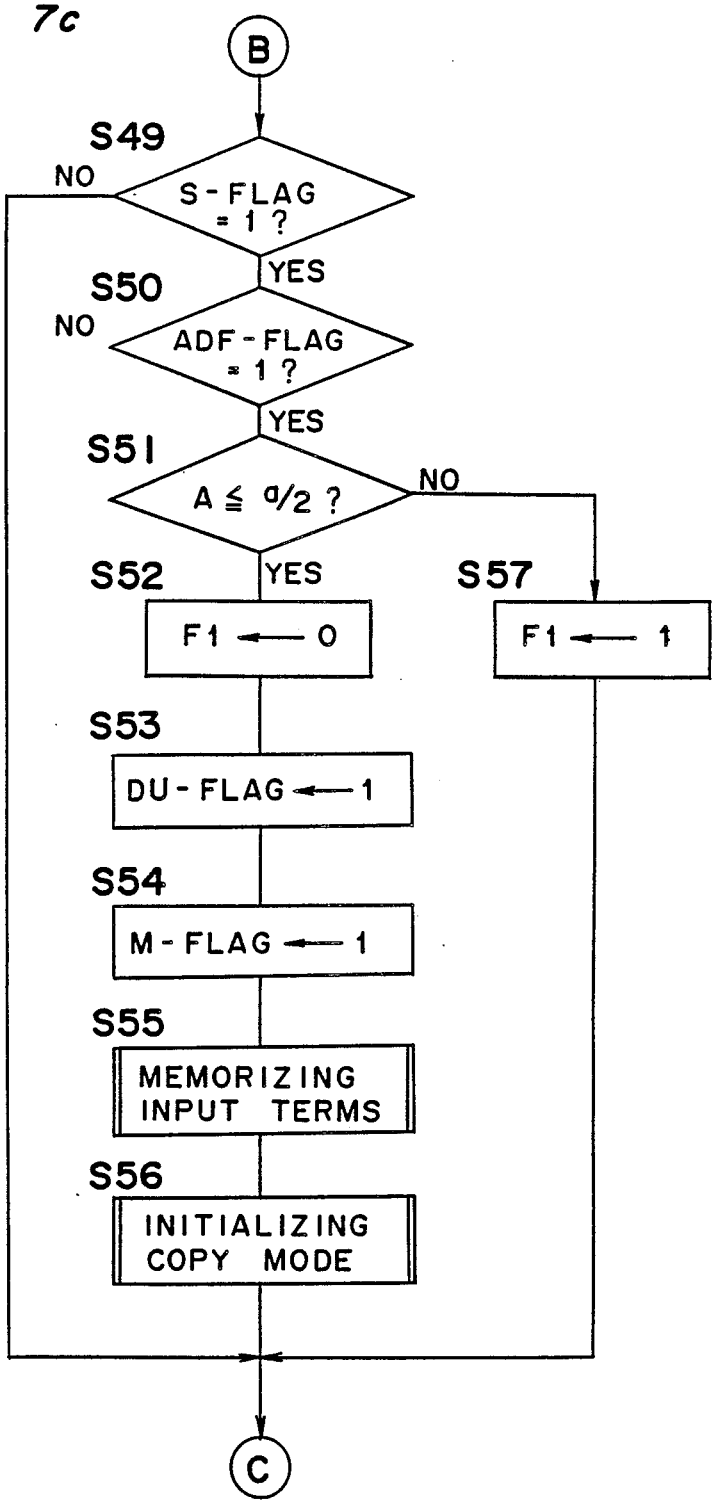
Figure 7D:
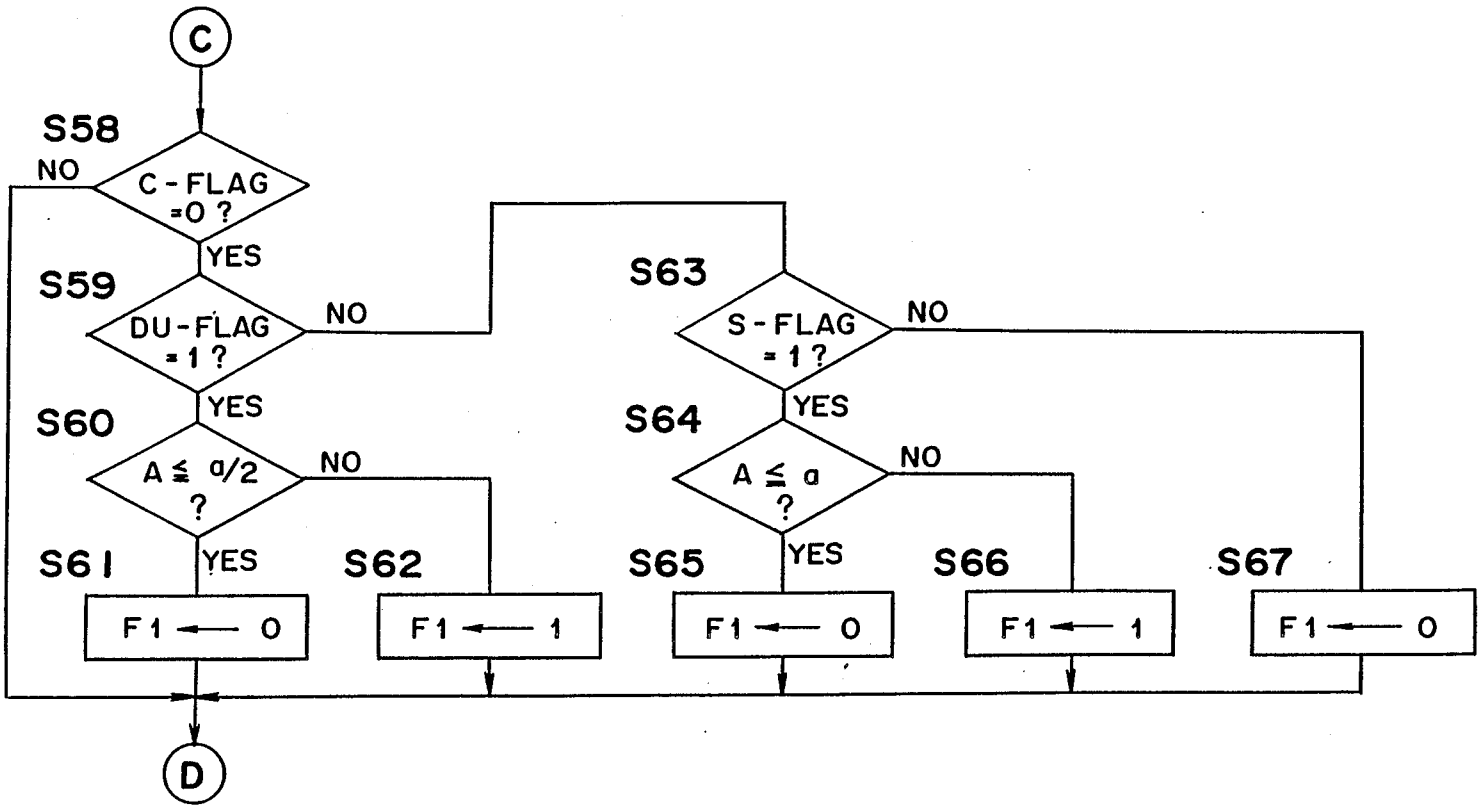

Referring to FIG. 7*d*, it is decided at steps S58 through S67 whether or not the predetermined number (A) of copies exceeds the number of bins when the sorting mode has been selected. It is decided whether or not the dual mode flag (DU-flag) and the sorting mode flag (S-flag) have been set to "1" at steps S59 and S63 after it is verified that the copy flag (C-flag) has been reset to "0" at step S58. If the dual mode has been selected (it is decided at step S59 that the dual mode has been selected), it is decided at step S60 whether or not the predetermined number (A) of copies is less than the number of bins (a/2). If it is decided that the number (A) of copies is less than the number of bins (a/2), the warning flag (F1-flag) is reset to "0". at step S61. If the number (A) of copies exceeds the number of bins (a/2), the warning flag (F1) is set to "1" at step S62. In the case where only the sorting mode is selected (it is decided at step S63 that the selection of the sorting mode has been made), it is decided at step S64 whether or not the predetermined number (A) of copies is less than the number of bins (a). If the predetermined number (A) of copies is less than the number of bins (a), the warning flag (F1) is reset to "0" and if the predetermined number (A) of copies is more than the number of bins (a), the warning flag (F1) is set to "1" at step S56.

Figure 7E:
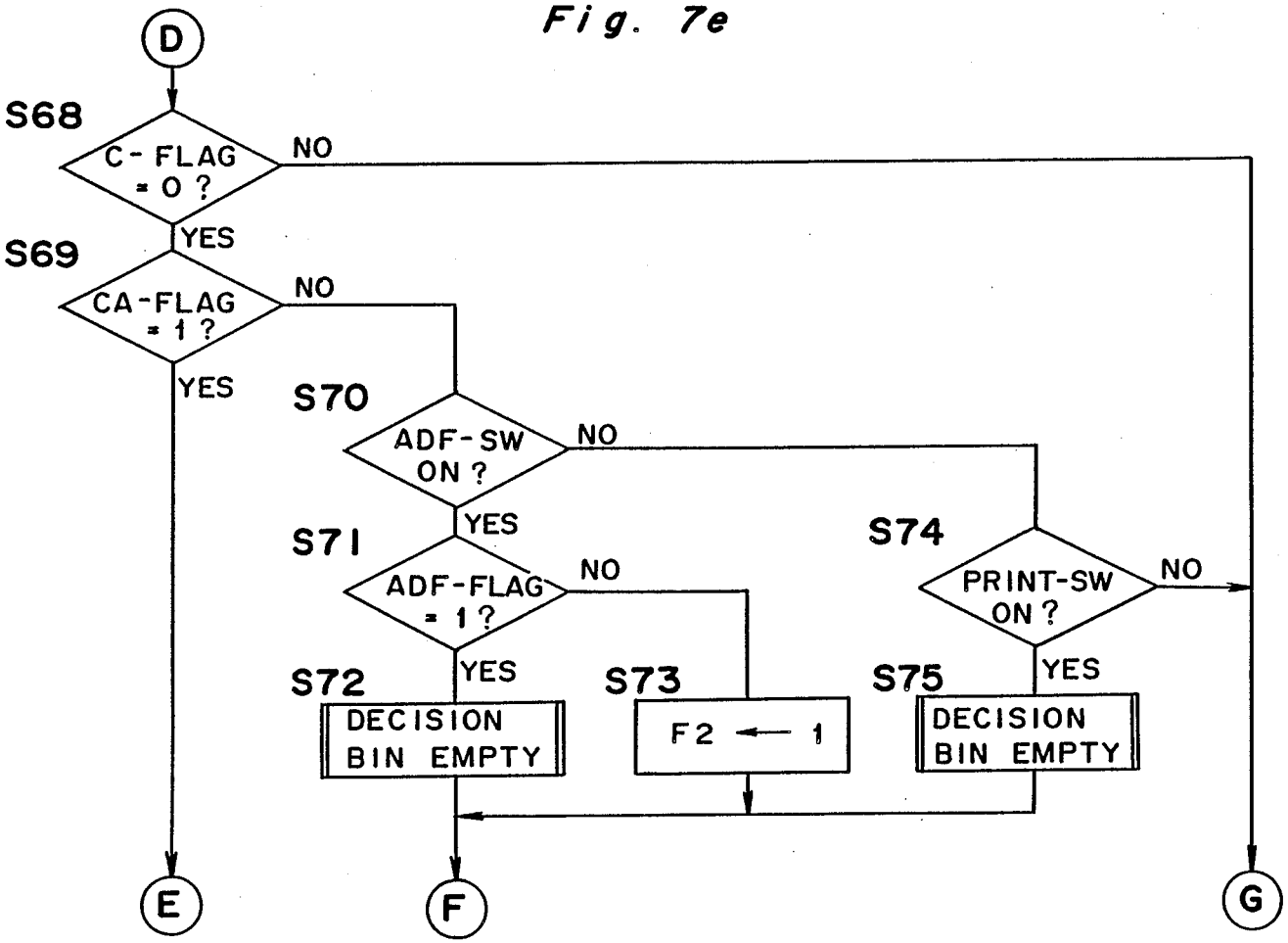

The start of a copying operation is accepted at steps subsequent to step S68 in FIG. 7*e*. First, after it is verified that the copy flag (C-flag) has been set to "0" at step S68, it is decided whether or not a copy operation accepting flag (CA-flag) has been set to "1". The copy operation accepting flag (CA-flag) is set to "1" when it is verified that no interference has occurred to the execution of the copy operation (refer to step S269 in FIG. 18). Accordingly, if it is decided that the CA-flag has been set to "1", the CA-flag is reset to "0" at step S76 and the copy flag (C-flag) is set to "1" at step S77, thus terminating the execution of this subroutine. If the copy accepting flag (CA-flag) is reset to "0", it is decided at steps S70 and S74 whether or not the ADF start switch 401 and the print switch 71 are at ON edges. When the ADF start switch 401 is turned on, it is decided at step S71 whether or not the ADF mode flag (ADF-flag) has been set to "1". If the ADF mode flag (ADF-flag) has been set to "1", the subroutine for judging "bin empty" is executed at step S72. If the ADF mode flag (ADF-flag) has not been set to "1", the warning flag (F2) is set to "1" at step S73. As described above, the warning flag (F2) indicates that original document tray 203 is empty. When the print switch 71 is turned on, the subroutine for judging "bin empty" is executed at step S75. If neither the switch 401 nor the switch 71 is turned on, the execution of this subroutine is terminated.

Figure 7F:
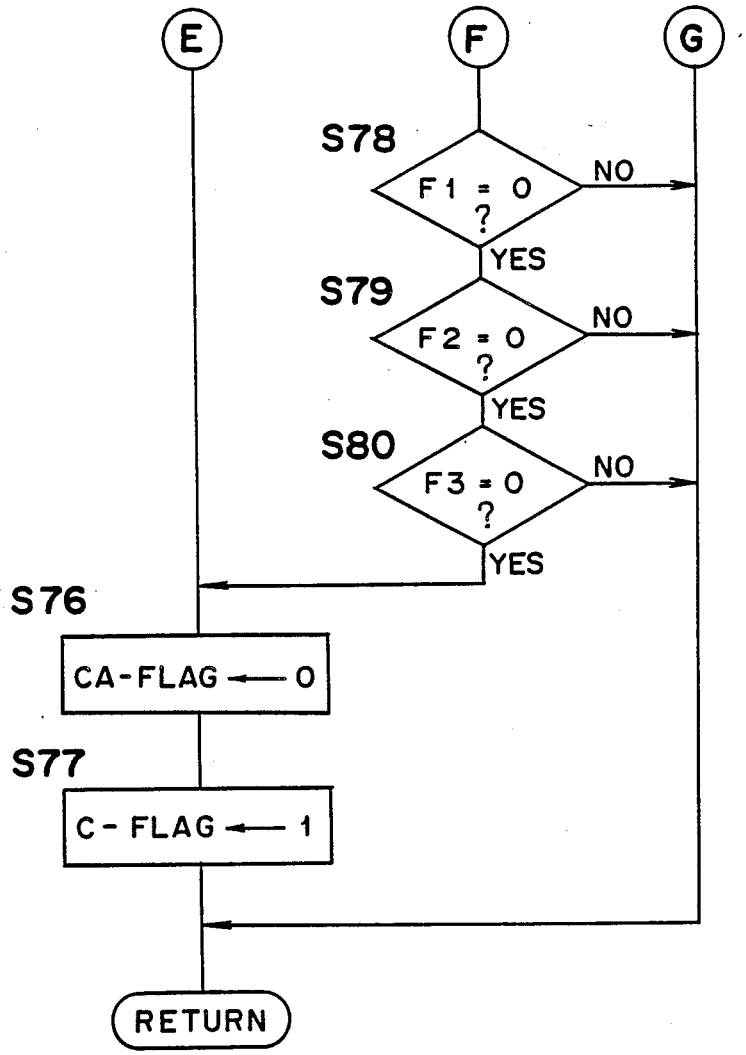

In FIG. 7*f*, either the switch 401 or the switch 71 is turned on, the copy accepting flag (CA-flag) is reset to "0" at step S76 after all the warning flags F1, F2, and F3 are reset to "0" at steps S78, S79, and S80, and the copy flag (C-flag) is set to "1", thus terminating the execution of this subroutine.

FIG. 8 shows a subroutine for judging "bin empty" to be executed at steps S72 and S75.

It is decided at step S90 whether or not the dual mode flag (DU-flag) has been set to "1". If the dual mode flag (DU-flag) has been set to "1", i.e., if the dual mode is executed, it is decided at steps S91 and S92 on the basis of the ONs or OFFs of a pair of the second sensors 321*a* and 321*b* whether or not copy sheets are accommodated in bins of the first and second groups of bins 301. If it is detected that copy sheets are accommodated in both groups of bins 301, the warning flag (F3) is set to "1" at step S93. If copy sheets are not accommodated in either the first group of bins 301 or the second group of bins 301, the warning flag (F3) is reset to "0" at step S93. That is, if either of the groups is empty, the execution of the dual mode is accepted.

When the dual mode is not executed, but a mode for possibly using all of the bins 301 are executed, it is decided a steps S95 and S96 whether or not copy sheets are on both the first and second groups of bins 301 on the basis of the ONs or OFFs of the second sensors 321*a* and 321*b*. Only when no copy sheets are on the first and second groups of bins, the warning flag (F3) is reset to "0" at step S97 and if copy sheets are accommodated in either the first group of bins 301 or the second group of bins 301, the warning flag (F3) is set to "1" at step S98. That is, the executions of modes other than the dual mode ar not accepted unless copy sheets are removed from all of the bins.

FIG. 9 shows a subroutine for setting the sorting mode to be executed at step S40.

The operation mode of the sorter 300 can be set except when the copying operation is being performed. It is decided whether or not the dual mode flag (DU-flag) has been reset to "0" at step S101 after it is verified at step S100 that the copy flag (CA-flag) has been reset to "0". Since the dual mode can be selected when the sorting mode has been selected (refer to steps S44 and S45 in FIG. 7*b*), the following steps are executed when the dual mode flag (DU-flag) has been reset to "0".

First, it is decided at step S102 whether or not the mode selection switch 411 is at ON edge. If the mode selection switch 411 is at ON edge, it is decided at steps S103, S106, and S109 whether or not the non-sorting mode flag (NS-flag), the sorting mode flag (S-flag), and the grouping mode flag (G-flag) have all been set to "1". If the non-sorting mode flag (NS-flag) has been set to "1", the sorting mode flag (S-flag) is set to "1" at step S104 and the non-sorting mode flag (NS-flag) is reset to "0" at step S105. If the sorting mode flag (S-flag) has been set to "1", the grouping mode flag (G-flag) is set to "1" at step S107 and the sorting mode flag (S-flag) is reset to "0" at step S108. If the grouping mode flag (G-flag) has been set to "1", the non-sorting mode flag (NS-flag) is set to "1" at step S110 and the grouping mode flag (G-flag) is reset to "0" at step S111. On the other hand, if these three flags have been reset to "0", the non-sorting mode flag (NS-flag) is set to "1" at step S112, and a single multi-job flag (SMJ-flag) is reset to "0" at step S113. The single multi-job which is executed when a predetermined number of copies is "1" is set at steps S145, S149, S150, and S151 in FIG. 11.

FIG. 10 shows a subroutine for an indication processing to be executed at step S4 of the main routine.

In this subroutine, first, it is decided whether or not the ADF mode flag (ADF-flag) has been set to "1" at step S120. If the ADF mode flag (ADF-flag) has been set to "1", the ADF mode is indicated at step S121, i.e., the LED 402 flashes and if the ADF mode flag (ADF-flag) has been reset to "0", the LED 402 is turned off at step S122. Subsequently, the indication of the sorting mode is processed with the subroutine at step S123 and any one of the mode indication LEDs 412, 413, and 414 flashes according to a selected operation mode. It is decided at step S124 whether or not the dual mode flag (DU-flag) has been set to "1". If the dual mode flag (DU-flag) has been set to "1", the dual mode is indicated at step S125, i.e., the LED 416 flashes. If the DU-flag has been reset to "0", the LED 416 is turned off at step S126.

At step S127, it is decided whether or not the warning flag (F1) has been set to "1". If the warning flag (F1) has been set to "1", the LED 417 flashes at step S128 to indicate that the number of copies exceeds the number of bins. If the warning flag (F1) has been reset to "0", the LED 417 is turned off at step S129. It is decided at step S130 whether or not the warning flag (F2) has been set to "1". If the warning flag (F2) has been set to "1", the LED 403 flashes at step S131 to indicate that the original document tray 203 is empty. If the warning flag (F2) has been reset to "0", the LED 403 is turned off at step S132. It is decided at step S133 whether or not the warning flag (F3) has been set to "1". If the warning flag (F3) has been set to "1", the LED 418 flashes at step S134 to warn that copy sheets are required to be removed from the bins. If the warning flag (F3) has been reset to "0", the LED 418 is turned off at step S135.

Next, it is decided at step S136 whether or not the copy flag (C-flag) has been set to "1". If the copy flag (C-flag) has been set to "1", the number of copies is indicated on the indication section 75 at step S137. If the copy flag (C-flag) has been reset to "0", the number of sheets which have yet to be copied is indicated on the display portion 75 at step S138. Thereafter, other indication processings are executed at step S139. Thus, the execution of this subroutine is terminated.

FIG. 11 shows the subroutine of the copy system processing to be executed at step S5 of the main routine.

First, it is decided at step S140 whether or not the ADF mode flag (ADF-flag) has been set to "1". If the ADF mode flag (ADF-flag) has been set to "1", the subroutine for the ADF mode processing is executed at step S141. Subsequently, it is decided at step S142 whether or not the non-sorting mode flag (NS-flag) has been set to "1". If the non-sorting mode flag (NS-flag) has been set to "1", the subroutine for the non-sorting mode is executed at step S143, the subroutine for a copy processing is executed at step S153, and the subroutine for other processings is executed at step S154.

On the other hand, if the non-sorting mode flag (NS-flag) has been reset to "0", it is decided at step S144 whether or not the sorting mode flag (S-flag) has been set to "1". If the sorting mode flag (S-flag) has been set to "1", it is decided at step S145 whether or not a predetermined number (A) of copies is one (1). If the predetermined number (A) of copies is not one (1), it is decided at step S146 whether or not the dual mode flag (DU-flag) has been set to "1". If the dual mode flag (DU-flag) has been set to "1", the subroutine for the dual mode processing is executed at step S147, the subroutine for the sorting mode processing is executed at step S148, the subroutine for a copy processing is executed at step S153, and the subroutine for other processings is executed at step S154. If the dual mode flag (DU-flag) has been reset to "0", the program immediately goes to step S148 at which the subroutine for the sorting mode processing is executed. If it is decided that the predetermined number (A) of copies is one (1), it is decided whether or not the flag on units of originals boundary detection mode (DG-flag) has been set to "1". If the DG-flag has been set to "1", the sorting mode flag (S-flag) is reset to "0" at step S150, the single multi-job flag (SMJ-flag) is set to "1" at step S151, and the subroutine for the grouping mode processing is executed at step S152. Thereafter, the subroutine for a copy processing is executed at step S153, and the subroutine for other processings is executed at step S154. If the units of originals boundary detection mode flag (DG-flag) has been reset to "0", the program goes to the subroutine of step S148.

Meanwhile, if it is decided at step S144 that the sorting mode flag (S-flag) has been reset to "0", the program goes to step S152 at which the grouping mode processing is executed.

Since the control procedure to be executed at step S143 is known, its description is omitted.

FIG. 12 shows a subroutine for the ADF mode processing to be executed at step S141 of the copy system processing (refer to FIG. 11).

In this subroutine, first, it is decided at step S160 whether or not the numerical value counted by an original document counter (DC) which counts the number of original documents is "0". If the numerical value counted by the counter (DC) is not "0", it is decided at step S161 whether or not the original document tray 203 is empty on the basis of the ON or OFF of the sensor (SE). If it is detected that the original document tray 203 is empty, it is decided that the ADF 200 has fed all original documents and the original document counter (DC) is reset at step S162, then the program goes to step S163. If it is detected at step S160 that the numerical value counted by the original document counter (DC) is "0", the program immediately goes to step S163 in preparation for an original document feeding processing of original documents to be placed on the original document tray 203.

Next, it is decided at step S163 whether or not the copy flag (C-flag) has been set to "1". If the copy flag (C-flag) has been reset to "0", the execution of this subroutine is immediately terminated. If the copy flag (C-flag) has been set to "1", the subroutine for the original document feeding processing is executed. Subsequently, if it is detected at step S165 that the ADF original document detecting sensor (SSE) is at OFF edge, the original document counter is incremented at step S166 and the subroutine for the original document size detection processing is executed at step S167.

Next, it is decided whether or not the flag on units of originals boundary detection mode (DG-flag) has been set to "1". If the DG-flag has been set to "1", the subroutine for the processing of the units of originals boundary detection mode is executed. Thereafter, it is decided at step S170 whether or not the flag on boundary of units of originals (ODS-flag) has been set to "1", i.e., it is decided whether or not a sheet supplied to the original document feeding section at this time is a partitioning sheet. If it is detected that the sheet supplied thereto is the partitioning sheet, the subroutine for an original document discharge processing is executed at step S172, and the partitioning sheet is discharged from the original document glass 16. If it is detected that the flag on boundary of units of originals (ODS-flag) has been reset to "0", i.e., if a sheet supplied thereto at this time is an original document, the subroutine for the original document discharge processing is executed at step S172 after verifying that the optical system 10 has scanned the same original document for a plurality of times corresponding to the predetermined number of copies and the subroutine for performing other processings is executed at step S173, thus terminating the execution of the ADF mode processing.

It is to be noted that the subroutines for the original document feeding and original document discharge processings to be executed at steps S164 and S172 are performed similarly to a known procedure. Therefore, the description of the details is omitted. The processing for detecting the size of the original document to be executed at step S167 is as described in the description of the operation of the ADF 200. Therefore, the description of the control procedure for detecting the size of the original document is omitted.

FIG. 13 shows the subroutine for processing the units of originals boundary detection mode (DG-mode) to be executed at step S169 of the ADF mode processing (refer to FIG. 12).

First, it is decided at step S180 whether or not the numerical value counted by the original document counter (DC) is less than "1". If the numerical value counted by the original document counter is less than "1", this subroutine is immediately terminated. That is, if a sheet supplied to the original document feeding section is a first sheet, it is decided that it must be an original document. Accordingly, it is unnecessary to execute the subsequent processings. When sheets are subsequently supplied, the size ($S_n$) of an original document currently supplied is compared at step S181 with the size ($S_{n-1}$) of an original document supplied one sheet prior to the sheet currently supplied, a size of each original document is detected on the basis of the combination of the following data: the ONs or OFFs of the sensors 210 and 211 and the numerical value counted by the counter as described previously. If the sizes are different from each other, the counter (B) is incremented by "1" at step S182, then, the program goes to step S183. If the sizes are the same, the program goes to step S183.

It is decided at step S183 whether or not the numerical value counted by the counter (B) is "1". If the counted value is "1", it is decided that a partitioning sheet of a different size has been supplied and the flag on boundary of units of originals (ODS-flag) is set to "1" at step S184. Thus, the execution of this subroutine is terminated. If it is decided at step S183 that the numerical value counted by the counter (B) is not "1", it is decided at step S185 whether or not the numerical value counted by the counter (B) is "2". If the numerical value counted by the counter (B) is "2", it is decided that a first sheet of a subsequent unit of originals has been supplied, then the flag on boundary of units of originals (ODS-flag) is reset to "0" at step S186 and the counter (B) is reset to "0" at step S187. Thus, the execution of this subroutine is terminated.

FIG. 14 shows the subroutine for the grouping mode processing to be executed at step S152 of the copy system processing (refer to FIG. 11).

This subroutine performs the processing to be carried out when the operation mode of the sorter 300 is in the grouping mode or when the operation mode of the sorter 300 is set to the single multi-job. That is, a preprocessing for setting the bins 301 to the home positions is executed at step S200; a processing for transporting copy sheets to predetermined bins 301 is executed at step S201; the post-processing (I) for resetting the positions of the bins 301 and for checking the condition of the bins 301, for example, which of the bins are empty are executed at step S202.

FIG. 15 shows the subroutine of the pre-processing to be executed at step S200.

In this subroutine, first, it is decided at step S210 whether or not the copy flag (C-flag) is at ON edge. If the copy flag (C-flag) is not at ON edge, the program goes to step S214 and if the copy flag (C-flag) is at ON edge, the program goes to steps S211 and S212 at which a bin counter (BC) and a sheet quantity counter (QC) are reset and a home position setting flag (HPS-flag) is set to "1" at step S213, then the program goes to step S214.

It is decided at step S214 whether or not the home position setting flag (HPS-flag) has been set to "1". If the home position setting flag (HPS-flag) has been reset to "0", this subroutine is immediately terminated. If the home position setting flag (HPS-flag) has been set to "1", the subroutine of the home position setting processing is executed at step S215. According to this subroutine, the upper and lower discharge rollers 313 and 313 of the sorter 300 are set in the positions from which copy sheets are discharged to each of the uppermost bins of the first and second groups of bins 301, which is known to those skilled in the art. Therefore, the detailed description of this mechanism is omitted.

Next, after verifying that the bins have returned to the respective home positions at step S216, it is decided at step S217 whether or not the sorting mode flag (S-flag) has been reset to "0". If the sorting mode flag (S-flag) has been reset to "0", the bin counter (BC) is incremented at step S218 and the home position setting flag (HPS-flag) is reset to "0". Thus, the execution of this subroutine is terminated. If the sorting mode flag (S-flag) has been set to "1", the program immediately goes to step S219.

FIG. 16 shows the subroutine of a copy sheet transporting processing to be executed at step S201.

First, when it is verified that the discharge switch 37 of the copying apparatus 100 is at ON edge at step S220, that is, when the leading edge of a copY sheet reaches a pair of the discharge rollers 24, the motor mounted in the sorter 300 for transporting the copy sheet to the sorter 300 is driven at step S221, wherebY the rollers 303, 311, and 313 mounted in the sorter 300 start rotating.

Next, when the first sensors **320*a* and 320*b* are at OFF edge at step S222**, i.e., when the copy sheet has been distributed to and accommodated in predetermined bins 301, it is decided at step S223 whether or not the sorting mode flag (S-flag) has been set to "1". If the sorting mode flag (S-flag) has been set to "1", the bin counter (BC) is incremented at step S224. If the sorting mode flag (S-flag) has been reset to "0", the sheet quantity counter (QC) is incremented at step S225.

Next, the motor timer is driven at step S226, and when it is confirmed at step S227 that the motor timer has completed counting, the operation of the motor for transporting copy sheets from the rollers 24 to the sorter 300 is stopped at step S228. Thus, the execution of this subroutine is terminated.

FIGS. 17*a* and 17*b* show the subroutine of the post-processing to be executed at step S202.

First, in FIG. 17*a*, it is decided at step S230 that a copy interruption flag (CI-flag) has been reset to "0". According to a function of the copy interruption flag (CI-flag), it allows a copy operation to be resumed after copy sheets accommodated in all the bins 301 are removed therefrom. So, the copy interruption flag (CI-flag) is set to "1" .at step S265 (refer to FIG. 18). If the copy interruption flag (CI-flag) has been set to "1", the program goes to step S245. If the copy interruption flag (CI-flag) has been reset to "0", it is decided at step S231 whether or not the copy flag (C-flag) has been set to "1". If the copy flag (C-flag) has been reset to "0", this subroutine is immediately terminated. If the copy flag (C-flag) has been set to "1", it is decided at step S232 whether or not the single multi-job flag (SMJ-flag) has been set to "1". If the single multi-job flag (SMJ-flag) has been set to "1", i.e., if the predetermined number (A) of copies is "1", it is decided at step S234 whether or not the flag on boundary of units of originals (ODS-flag) has been reset to "0". If the ODS-flag has been set to "1", i.e., if the copying of one unit of originals has been completed and a partitioning sheet has been supplied, the program goes to step S243. If the ODS-flag has been reset to "0", i.e., the copying of one unit of originals is in operation, it is decided at step S235 whether or not a numerical value (q) counted by the sheet quantity counter (QC) is equal to a sheet-accommodating capacity (Q) per bin. It is to be noted here that the above-mentioned numerical value (q) means the number of copy sheets which have been accommodated in a bin. If it is decided at step S235 that the numerical value (q) is not equal to the sheet-accommodating capacity (Q), i.e., if there is room for accommodating sheets in a bin 301 which is currently used at the moment, the execution of this subroutine is terminated. It is decided that the value (q) is equal to the capacity (Q), i.e., there is no room for that, the program goes to step S243.

If it is decided at step S232 that the single multi-job flag (SMJ-flag) has been reset to "0", that is, while the copy mode is in the grouping mode with a predetermined number (A) of copies being more than "2", it is decided at step S236 whether or not a flag for plural bins (PB-flag) has been reset to "0". When the flag for plural bin (PB-flag) has been set to "1", it indicates that a plurality of bins 301 are used for one sheet of an original document (refer to step S242). If the flag for plural bin (PB-flag) has been reset to "0", the predetermined number (A) of copies is set to a copy completion decision value (C) for one original document at step S237, then the program goes to step S238. If the flag for plural bins (PB-flag) has been set to "1", the program immediately goes to step S238.

It is decided at step S238 whether or not the numerical value (q) counted by the sheet quantity counter (QC) equals to the copy completion decision value (C). If the numerical value (q) is unequal to the value (C), i.e., if the number of sheets accommodated in one bin 301 has not reached the decision value (C), it is decided at step S240 whether or not the numerical value (q) is equal to the sheet-accommodating capacity (Q). If the numerical value (q) has not reached the sheet-accommodating capacity (Q), the execution of this subroutine is immediately terminated. If the former has reached the latter, a (C) subtraction flag (CD-flag) is set to "1" at step S241. According to a function of the (C) subtraction flag (CD-flag), it allows a bin 301 to be switched to a bin disposed one step lower so as to resume the counting of the number of copy sheets to be accommodated in the bins. Thereafter, the flag for plural bin (PB-flag) is set to "1", then, the program goes to step S243. On the other hand, if it is decided at step S238 that the counted numerical value (q) of the number of copy sheets has reached the decision value (C), the flag for plural bin (PB-flag) is reset to "0", then, the program goes to step S243.

Next, in FIG. 17*b*, it is decided at step S243 whether or not the numerical value (q) (q: number of bins in use) counted by the bin counter (BC) is equal to the number (a) of bins. If it is decided that the numerical value (q) is less than the number of bins (a), the subroutine for shifting the bin 301 by one step is executed at step S244, and when it is verified at step S246 that the bin 301 has shifted by one step, it is decided at step S247 whether or not the (C) subtraction flag (CD-flag) has been set to "1". If the (C) subtraction flag (CD-flag) has been reset to "0", the program goes to step S250. If the (C) subtraction flag (CD-flag) has been set to "1", the (C) subtraction flag (CD-flag) is reset to "0" at step S248 and the value of [(A)-(Q)] is set to the decision value (C) at step S249. Thereafter, the bin counter (BC) is incremented at step S250, and the sheet quantity counter (QC) is reset at step S251. Thus, the execution of this subroutine is terminated.

If it is decided at step S243 that the numerical value (q) counted by the bin counter (BC) has reached the number of bins (a), the subroutine of the operation continuation decision which is described in detail hereinbelow is executed at step S245.

The subroutine for shifting the bin 301 by one step to be executed at step S244 is to move the discharge roller 313 to the position for discharging copy sheets to the bin 301 disposed one step lower and is to enlarge the interval between adjacent bins to which copy sheets are discharged. The sorter having such a mechanism is well known.

FIG. 18 shows the subroutine for the operation continuation decision to be executed at step S245 in the subroutine of the above-described post-processing (I).

According to this subroutine, a copying operation is interrupted in the case where all the bins 301 of the sorter 300 have been occupied with the predetermined number of copy sheets nevertheless original documents still remain on the original document tray 203 of the ADF 200, and then, a copying operation is resumed after detecting that copy sheets have been removed from the bins.

First, it is decided at step S260 on the basis of the ONs or OFFs of the second sensors 321*a* and 321*b* whether or not copy sheets are on the bins 301. If it is detected at step S261 that copy sheets are on the bins 301, the warning flag (F3) is set to "1" at step S261, and a bin resetting flag (BR-flag) and the copy flag (C-flag) are reset to "0" at steps S262 and S263. Subsequently, it is decided at step S264 on the basis of the ON or OFF of the sensor (ES) whether or not the original documents are still on the original document tray 203. If it is detected that there are no original documents thereon, the execution of this subroutine is terminated. To the contrary, if it is detected that there are original documents thereon, the copy interruption flag (CI-flag) is set to "1" at step S265. Thus, the execution of this subroutine is terminated. When the warning flag (F3) is set to "1" at step S261 and the LED 418 flashes, an operator who has found the flashing of the LED 418 removes copy sheets from the bins 301.

When the copy sheets are removed from the bins 301 and if it is detected that no sheets are accommodated in the bins 301 at step S260, the warning flag (F3) is reset to "0" at step S266, and it is decided at step S267 whether or not the cop interruption flag (CI-flag) has been set to "1". If it is detected that the copy interruption flag (CI-flag) has been reset to "0", the execution of this subroutine is terminated. If it is detected that the copy interruption flag (CI-flag) has been set to "1", the copy interruption flag (CI-flag) is reset to "0", and the copy accepting flag (CA-flag) is set to "1". Thus, the execution of this subroutine is terminated.

FIG. 19 shows the subroutine for the sorting mode processing to be executed at step S148 of the copy system processing (refer to FIG. 11).

In this subroutine, similarly to the grouping mode shown in FIG. 14, the pre-processing is executed at step S270, the copy sheet transporting processing is executed at step S271, and a post-processing II is executed at step S272. The subroutines of steps S270 and S271 are same as those shown in FIGS. 15 and 16.

FIG. 20 shows the subroutine of the post-processing II to be executed at step S272 of the sorting mode processing.

First, it is decided at step S280 whether or not the copy interruption flag (CI-flag) has been reset to "0". If the copy interruption flag (CI-flag) has been set to "1", the program immediately goes to step S293 so as to execute the subroutine of the operation continuation decision. When the copy interruption flag (CI-flag) has been reset to "0" and it is verified at step S281 that the copy flag (C-flag) has been set to "1", the following processings are executed.

That is, it is decided at step S282 whether or not the numerical value (p) counted by the bin counter (BC) equals to the predetermined number (A) of copies. Until the numerical value (p) counted by the bin counter (BC) reaches the predetermined number (A) of copies, the subroutine for shifting the bin 301 by one step is executed at step S283. When it is detected at step S284 that the bin shifting processing has been completed, the bin counter (BC) is incremented at step S285, then the program goes to step S292.

On the other hand, if it is decided that the numerical value (p) counted by the bin counter (BC) has reached the predetermined number (A) of copies, it is decided at step S286 whether or not the flag on boundary of units of originals (ODS-flag) has been set to "1". If the ODS-flag has been set to "1", the home position alteration flag (HPA-flag) is set to "1", then the program goes to step S292. That is, when the copy processing of one unit of originals has been completed, another group of bins to which copy sheets corresponding to the subsequent unit of originals are distributed and accommodated therein is selected. If it is detected at step S286 that the flag on boundary of units of originals (ODS-flag) has been reset to "0", it is decided at step S288 whether or not the original document tray 203 is empty, on the basis of the ON or OFF of the sensor (SE). If it is detected that the original documents are on the original document tray 203, the bin resetting flag (BR-flag) is set to "1" at step S289, and the sheet quantity counter (QC) is incremented at step S290, then the program goes to step S292. If it is detected that no original documents are on the original document tray 203, the copy flag (C-flag) is reset to "0" at step S291, then the program goes to step S292. The bin-resetting flag has a function that when the bin-resetting flag (BR-flag) is set to "1", it issues an instruction that the distribution of copy sheets to the bins is resumed from the home positions of the group of bins which is currently in use.

It is decided at step S292 whether or not the numerical value (q) counted by the sheet quantity counter (QC) is equal to the sheet-accommodating capacity (Q) per bin. If it is decided that the former is unequal to the latter, the execution of this subroutine is terminated. If it is decided that the former is equal to the latter, the subroutine for performing the operation continuation decision is executed at step S293. The processing to be executed at step S293 is same as that of the subroutine for performing the operation continuation decision shown in FIG. 18.

FIG. 21 shows the subroutine for performing the dual mode to be executed at step S147 of the copy system processing (refer to FIG. 11.)

First, it is decided at step S300 whether or not the home position alteration flag (HPA-flag) has been set to "1". As shown at step S287 of the post-processing subroutine of the sorting mode processing, the home position alteration flag (HPA-flag) is set to "1" when the boundary between units of originals is detected. Accordingly, when the home position alteration flag (HPA-flag) is reset to "0", the execution of this subroutine is immediately terminated. If the home position alteration flag (HPA-flag) has been set to "1", it is decided at steps S301 and S307 on the basis of the ON or OFF of the second sensors 321*a* and 321*b* whether or not copy sheets are both on the first unit of bins 301 and the second unit of bins 301.

If it is verified at step S301 that no copy sheets are accommodated in the first group of bins 301, the warning flag (F3) is reset to "0" at step S302 and the subroutine for setting the home position for starting the distribution of copy sheets to the first group of bins is executed at step S303. Thereafter, when it is confirmed at step S304 that the home position has been set, the home position alteration flag (HPA-flag) is reset to "0" at step S305, and the copy accepting flag (CA-flag) is set to "1" at step S306. Thus, the execution of this subroutine is terminated.

On the other hand, if it is verified at step S307 that the second group of bins 301 accommodates no copy sheets, the warning flag (F3) is reset to "0" at step S308, and the subroutine for setting the home position of the bins for starting the distribution of copy sheets to the second group of bins is executed at step 309. Thereafter, when it is verified at step S310 that the home position has been set, the processings to be performed at steps S305 and S306 are executed. Thus, the execution of this subroutine is terminated.

When it is decided at steps S301 and S307 that copy sheets are on the first and second groups of bins 301, the warning flag (F3) is set to "1" at step S311 and the copy flag (C-flag) is reset to "0" at step S312.

As apparent from the foregoing description, according to one embodiment of the present invention, when the execution of the dual mode is selected, the copying condition can be inputted for each of the units of originals in advance. In addition, when the boundary between units of originals having original documents which are supplied one by one by the automatic document feeder is detected, original documents of the subsequent unit of originals can be copied with the pre-inputted copying condition, so that the copying condition of the respective units of originals may be automatically varied by one copy starting operation.

Furthermore, when the boundary between units of originals having original documents sequentially fed by the automatic document feeder is detected, copy sheets corresponding to the subsequent unit of originals are distributed to a group of bins other than the group of bins in use, which is empty, and accommodated therein. Owing to the dual function of the sorter, copy sheets respectively corresponding to units of originals can be distributed for each of the units of originals by one copy starting operation.

Although the present invention has been fully described by way of example with reference to the accompanying drawings, it is to be noted here that various changes and modifications will be apparent to those skilled in the art.

For example, regarding the detection of the boundary between units of originals in particular, in addition to the use of a sheet which is different in its size from the sizes of original documents as described above, other methods may be used to detect the boundary therebetween. For example, a mark sheet or a color sheet is inserted between units of originals; information is given to a first sheet of each of units of originals so that the information is optically detected. It is to be noted that the boundary detection to be performed by the original document size detecting means provided with the apparatus based on the difference in the sizes of sheets is more convenient than the boundary detection by using the marked sheet or the optically detecting method.

When all the bins become full of copy sheets while a copying operation is being performed in the sorting mode or the grouping mode, the following operations may be performed.

(1) Copy sheets subsequently discharged to the sorter are collected by the final bin. In this case, a color sheet or a sheet whose size is different from the sizes of units of originals is inserted therebetween so as to distinguish the copy sheets from each other.

(2) When the images of one unit of originals to be accommodated in the final bin are all copied, i.e., when the boundary between units of originals is detected, the operation of the ADF 200 is stopped and a copy prohibiting signal or a warning signal is applied to the copying apparatus 100.

In the above-described embodiment, the copying operation of units of originals placed in a lump on the original document-placing tray 203 of the ADF 200 is successively controlled. In this case, when the units of originals have all fed from the original document-placing tray to the original document feeding section, the copying operation is interrupted for a certain period of time with original documents empty on the original document-placing tray 203.

When a predetermined number (A) of copies exceeds the number of bins, the following operations are considered.

(1) The LED indicative of the number of the predetermined number of copies placed on the indication portion is flashed.

(2) The predetermined number (A) of copies is automatically changed to the maximum number of bins.

(3) The dual mode is released and a copying operation is effected in a sorting mode (in this case, an inputted copying data is cancelled.)

When with respect to a first unit of originals in the dual mode, the number of copy sheets to be accommodated in a bin exceeds the capacity of the bin, the following operations may be performed:

(1) Copy sheets are discharged to a second group of bins because the first group of bins are full of copy sheets and reserved copying data of a subsequent unit of originals is cancelled.

(2) Copy sheets are accommodated in the second group of bins instead of the first group of bins. When the number of copy sheets exceeds the capacity of the second group of bins, the copying operation is prohibited. However, when copy sheets are removed from the first group of bins while copy sheets are being distributed to the second group of bins, the copying operation is continued.

With regard to units of originals boundary detection mode, when the selection key 404 for units of originals boundary detection mode is OFF, the above-described units of originals boundary detection mode is executed. Alternatively, when the selection key 404 is ON, the units of originals boundary detection mode is executed only when it is detected a partitioning sheet whose size is specified. In this case, it is preferable that the specified size of the partitioning sheet is determined as desired.

Therefore, unless otherwise such changes and modifications will depart from the scope of the present invention, they should be construed as included therein.

What is claimed is:

1. A copying apparatus comprising:

automatic original document feeding means, provided with an original document-placing tray, for feeding original documents placed on said original document-placing tray to a predetermined position sheet by sheet;

copying means for copying an image of said original document fed to said predetermined position onto a copy sheet;

sorting means having a plurality of bins to accommodate copy sheets onto which images have been copied and a distribution mechanism for distributing said copy sheets to said bins;

input means for setting the number of copy sheets to be copied for an original document;

discrimination means for discriminating a boundary between units of originals placed on said original document-placing tray, each of said units of originals including one or more original documents;

first control means for controlling said sorting means so as to change one of said bins to another to accommodate said copy sheets to be distributed every time said boundary is detected by said discrimination means only when the number of copy sheets to be copied is set to one by said input means; and second control means for controlling said sorting means so as to change one of said bins to another to accommodate said copy sheets when the number of said copy sheets having been accommodated in said one bin exceeds a predetermined number while a copying operation for said each unit of originals are being performed.

2. A copying apparatus as claimed in claim 1, wherein said discrimination means is provided with first detecting means for detecting a size of said original document and second detecting means for detecting said boundary by signals from said first detecting means in response to a variation of the size of said original document being fed.

3. A copying apparatus comprising:

automatic original document feeding means, provided with an original document-placing tray, for feeding original documents placed on said original document-placing tray to a predetermined position sheet by sheet;

copying means for copying an image of said original document fed to said predetermined position onto a copy sheet;

sorting means having a plurality of bins to accommodate copy sheets onto which images have been copied and a distribution mechanism for distributing said copy sheets to said bins, said plurality of bins being divided into a plurality of groups in advance, said distribution mechanism distributing said copy sheets to each of said groups of bins independently;

discrimination means for discriminating a boundary between units of originals placed on said original document-placing tray, each of said units of originals including one or more original documents; and control means for controlling said sorting means so as to distribute said copy sheets for each of said units of originals to each of said groups of bins correspondingly based on the detection of said boundary effected by said discrimination means.

4. A copying apparatus as claimed in claim 3, further comprising:

input means for inputting data of a copying condition with respect to said respective units of originals;

memory means for memorizing said data inputted by said input means; and setting means for setting said copying condition corresponding to a subsequent unit of originals when said boundary is discriminated by said discrimination means.

5. A copying apparatus comprising:

automatic original document feeding means, provided with an original document-placing tray, for feeding original documents placed on said original document-placing tray to a predetermined position sheet by sheet;

copying means for copying an image of said original document fed to said predetermined position onto a copy sheet;

sorting means having a plurality of bins to accommodate copy sheets onto which images have been copied and a distribution mechanism for distributing said copy sheets to said bins, said plurality of bins being divided into a plurality of groups in advance, said distribution mechanism distributing said copy sheets to each of said groups of bins independently;

discrimination means for discriminating a boundary between units of originals placed on said original document-placing tray, each of said units of originals including one or more original documents;

detecting means for detecting whether or not said copy sheets are accommodated in said respective groups of bins;

first control means, for controlling said sorting means, which allows said copy sheets corresponding to said original documents of a subsequent unit to be accommodated in a group of bins accommodating no copy sheets when said boundary is discriminated by said discrimination means; and second control means for interrupting an operation of said copying apparatus in the case where said copy sheets are accommodated in all groups of bins at the time when the detection of said boundary is effected by said discrimination means.

6. A copying apparatus as claimed in claim 5, wherein said second control means has a function of resuming said operation of said copying apparatus when said copy sheets are removed from any one of said groups of bins during interruption of said operation of said copying apparatus.

7. A copying apparatus as claimed in claim 5, further comprising:

input means for inputting data of a copying condition with respect to said respective units of originals;

memory means for memorizing said data inputted by said input means; and setting means for setting said copying condition corresponding to said subsequent unit of originals when said boundary is discriminated by said discrimination means.

8. A copying apparatus comprising:

automatic original document feeding means, provided with an original document-placing tray, for feeding original documents placed on said original document-placing tray to a predetermined position sheet by sheet;

copying means for copying an image of said original document fed to said predetermined position onto a copy sheet;

sorting means having a plurality of bins to accommodate copy sheets onto which images have been copied and a distribution mechanism for distributing said copy sheets to said bins, said plurality of bins being divided into a plurality of groups, said distribution mechanism distributing said copy sheets to each of said groups of bins independently;

discrimination means for discriminating a boundary between units of originals placed on said original document-placing tray, each of said units of originals including one or more original documents;

detecting means for detecting whether or not said copy sheets are accommodated in said respective groups of bins;

input means for inputting the number of copy sheets to be copied;

setting means for setting a specific mode;

control means for controlling said sorting means, which, in said specific mode, allows distribution of said copy sheets of said respective units of originals to said respective groups of bins based on the detection of said boundary effected by said discrimination means; and means for allowing said setting means to set said specific mode only when said number of copy sheets inputted by said input means is not more than the number of bins of said respective groups of bins and no copy sheets are accommodated in any of said groups of bins.

9. A copying apparatus as claimed in claim 2, wherein said first detecting means comprises:

a pair of sensors, disposed in a sheet feeding path of said original document, for detecting an existence of said original document, said each sensor including a light emitting element and a light receiving element and being arranged at a predetermined interval along a direction crossing a feeding direction of said original document at a right angle so that said first sensor detects said original document every time said original document passes said first sensor and said second sensor may detect said original document depending on a size of said original document; and counting means for counting the member of pulses in a pulse signal with a predetermined pitch while said first sensor detects said original document;

whereby a calculation of size detection is executed with a numeral value counted by said counting means and a state of an output signal produced by said second sensor under a formulated relationship between the number of pulses and an actual length of an original document.

10. A copying apparatus as claimed in claim 9, wherein said first sensor is located at a center of said sheet feeding path and a relationship on said interval between said first and second sensors is satisfied with a following equation;

$$74\ \text{mm} < X_1 < 105\ \text{mm}$$

where, $X_1$ is said interval.

11. A copying apparatus as claimed in claim 9, wherein said first sensor is located at one side edge of said sheet feeding path and a relationship on said interval between said first and second sensors is satisfied with a following equation;

$$148\ \text{mm} < X_2 < 210\ \text{mm}$$

where, $X_2$ is said interval.

12. A copying apparatus comprising:

an original document-placing tray on which original documents are placed;

feeding means for feeding the original documents placed on said original document-placing tray;

copying means for copying an image of the original document fed by said feeding means on a copy sheet;

a plurality of bins;

distributing means for distributing the copy sheets onto which images have been copied to said bins;

detecting means for detecting a size of the original document;

discrimination means for discriminating a boundary between units of originals placed on said original document-placing tray in response to a variation of the size of the original document, each of said units of originals including one or more original documents;

setting means for setting a number of copy sheets to be obtained for each original document;

judging means for judging that the number of copy sheets to be obtained is set to one by said setting means; and means responsive to said judging means for controlling said distributing means so as to change over the bins to accommodate the copy sheets every time said boundary is discriminated by said discrimination means, and to change over the bins to accommodate the copy sheets when the number of the copy sheets having been accommodated in one of the bins exceeds a predetermined number.

13. A copying apparatus comprising:

an original document-placing tray on which original documents are placed;

feeding means for feeding the original documents placed on said original document-placing tray;

copying means for copying an image of the original document fed by said feeding means on a copy sheet;

a plurality of bins being divided into a plurality of groups in advance;

distributing means for distributing the copy sheets onto which images have been copied to said bins;

detecting means for detecting a size of the original document;

discrimination means for discriminating a boundary between units of originals placed on said original document-placing tray in response to a variation of the size of the original document, each of said units of originals including one or more original documents;

means responsive to said discriminating means for controlling said distributing means so as to distribute the copy sheets for each of the units of originals to each of the groups of bins correspondingly.

14. A copying apparatus comprising:

an original document-placing tray on which original documents are placed;

feeding means for feeding the original documents placed on said original document-placing tray;

copying means for copying an image of the original document fed by said feeding means on a copy sheet;

a plurality of bins being divided into a plurality of groups in advance;

distributing means for distributing the copy sheets onto which images have been copied to said bins;

first detecting means for detecting a size of the original document;

discrimination means for discriminating a boundary between units of originals placed on said original document-placing tray in response to a variation of the size of the original document, each of said units of originals including one or more original documents;

second detecting means for detecting whether said copy sheets are accommodated in the respective groups of bins; and means responsive to said second detecting means for controlling said distributing means so as to distribute the copy sheets for each of the units of originals to a group of bins accommodating no copy sheets, and for interrupting an operation of said copying apparatus in the case where the copy sheets are accommodated in all groups of bins, when the boundary is discriminated by said discrimination means.

15. A copying apparatus comprising:

an original document-placing tray on which original documents are placed;

feeding means for feeding the original documents placed on said original document-placing tray;

copying means for copying an image of the original document fed by said feeding means on a copy sheet;

a plurality of bins being divided into a plurality of groups;

distributing means for distributing the copy sheets onto which images have been copied to said bins;

detecting means for detecting a size of the original document;

discrimination means for discriminating a boundary between units of originals placed on said original document-placing tray in response to a variation of the size of the original document, each of said units of originals including one or more original documents;

setting means for setting a specific mode;

means responsive to said discriminating means for controlling said distributing means so as to distribute the copy sheets for each of the respective units of originals to the respective groups of bins in the specific mode; and means for allowing said setting means to set the specific mode only when the number of copy sheets inputted by said input means is not more than a predetermined number.

* * * * *